US007793623B2

(12) United States Patent
Bahnev

(10) Patent No.: US 7,793,623 B2
(45) Date of Patent: Sep. 14, 2010

(54) PISTON CAM ENGINE

(76) Inventor: Boyan Kirilov Bahnev, 40 Kapitan, Raytcho Street, 4000 Plovdiv (BG)

( * ) Notice: Subject to any disclaimer, the term of this patent is extended or adjusted under 35 U.S.C. 154(b) by 334 days.

(21) Appl. No.: 11/996,967

(22) PCT Filed: Sep. 29, 2006

(86) PCT No.: PCT/BG2006/000017

§ 371 (c)(1),
(2), (4) Date: Jan. 27, 2008

(87) PCT Pub. No.: WO2007/036007

PCT Pub. Date: Apr. 5, 2007

(65) Prior Publication Data

US 2008/0289606 A1 Nov. 27, 2008

(30) Foreign Application Priority Data

Sep. 30, 2005 (BG) ..... 109312

(51) Int. Cl.
*F02B 75/18* (2006.01)

(52) U.S. Cl. ..... 123/56.1; 123/56.2; 123/197.1

(58) Field of Classification Search ..... 123/56.1–56.9, 123/197.1
See application file for complete search history.

(56) References Cited

U.S. PATENT DOCUMENTS 2,401,466 A * 6/1946 Davis et al. ..... 123/51 BC
3,757,748 A * 9/1973 Arney ..... 123/45 A
2002/0043226 A1* 4/2002 Gofron ..... 123/56.1

* cited by examiner

*Primary Examiner*—Noah Kamen
(74) *Attorney, Agent, or Firm*—Nexsen Pruet, LLC.; Michael Mann

(57) ABSTRACT

The invention relates to a piston cam engine used in different field of the mechanical engineering, as internal-combustion engines compressors, pumps etc. The cam engine comprises cylinders (13) with pistons (20), a cylindrical tubular 3D cam (3) having a cam groove on the inner cylindrical surface and at least two guides (10) which are guide columns. The cam (3) is composed and includes two coaxial bushes (3*a*, 3*b*), each one having corrugated cam section (95*a* or 95*b*) from its one side and flange (35) from its other side besides the bushes (3*a*, 3*b*) are positioned against each other with its corrugated ends at a distance from each other, and further comprises spacer (37) between the flanges (35) of the bushes (3*a*, 3*b*), so as to form the cam groove having a constant section.

44 Claims, 19 Drawing Sheets

PISTON CAM ENGINE

FIELD OF THE INVENTION

The invention relates to a piston cam engine and particularly to an opposite piston cam engine, used in different field of the mechanical engineering, as internal-combustion engines, compressors, pumps etc. Engines could be integrated in various land, water and air vehicles, as well as in stationary units.

BACKGROUND OF THE INVENTION

The most important and perspective application of opposite piston mechanisms converting the reciprocal linear piston motion into rotation towards output shafts and vice versa is in the field of internal combustion engines.

There are known from DE 3347859, RU 2069273, RU 2073092, RU 2089733, RU 2118472 etc., opposite piston cam engines comprising a housing, a drive or driven shaft, a cylindrical tubular 3D cam having a cam groove on the inner cylindrical surface, opposite coaxial cylinders mounted in the housing, as well as pistons moving in the cylinders and followers having end pieces for moving in the cam groove connected to the pistons. The opposite pistons of these known cam engines are fixed each other and have synchronized motion. Although these engines have a simplified construction and possibility for reduction of contact pressure that occurs in contact areas of the cam groove and end pieces of the followers, they have not elements moving in reciprocal of the pistons direction to create balance inertial force.

There are also known from SU 1525284 and SU 1705600 another opposite piston cam engines including a housing, a drive or driven shaft, a cylindrical tubular 3D cam having a cam groove on the inner cylindrical surface, opposite coaxial cylinders mounted in the housing, as well as pistons moving in the cylinders connected with followers having end pieces for moving in the cam groove. Each piston of these engines has own follower having arm with end piece for independent movement in the cam groove. Thus it is possible for the pistons to move in opposite directions and their inertial forces to be neutralized. The end pieces for movement in the cam groove are rollers bearing by the free ends of the arms. The rectilinear movement of the pistons is ensured by other rollers mounted also on the free ends of the arms of the follower, but moving in a guide groove formed in the housing. It is a main disadvantage of these engines that the linear guidance of the followers is performed by guide groove which provokes arising of micro strokes in between the contact surfaces of the rollers and the groove when the direction of piston motion has changed. Besides in order to ensure precise guidance of the pistons, the cylinders and the pistons must be manufactured with a high precision. 3D cam is monolithic and it is difficult to produce the internal cam groove with high precision. All above complicates the technology and increases the manufacturing costs.

SUMMARY OF THE INVENTION

The problem solved by the present invention is to provide a piston cam engine which is balanced and reliable, as well as noise and vibrations are decreased.

This and other problems are solved by a piston cam engine comprising a housing, a drive or driven shaft, a cylindrical tubular 3D cam having a cam groove on the inner cylindrical surface. The 3D cam is composed. It includes two coaxial bushes, each one having corrugated cam section from its one side and flange from its other side, besides the bushes are positioned against each other with its corrugated ends in such a way that the convexities of one of the cam sections are positioned against concavities of the other at a distance from each other. The cam further comprises spacer between the flanges of the bushes, so as to form the cam groove having a constant section. There is a possibility the groove to be controlled for ensuring a permanent contact between the rollers and the corresponding cam section. Thus an endless corrugated cam groove on the inner cylindrical surface is performed, having constant cross section. The engine further comprises at least one cylinder, as well as at least one piston moving in the cylinder and at least one inertial balancer of the piston controlled by the cam. The engine further comprises at least two guides for linear reciprocal motion of each piston and each balancer, followers having at least two arms connected to the pistons and to the balancers. The guides according to the invention are guide columns, parallel and equally placed compared to the axes of the cam. Each one of the followers is equally placed compared to the axes of power transmission. On the ends of the arms rollers are mounted for moving in the cam groove. In the engine according to the invention the micro impacts between the contact surfaces of the rollers and the cam groove are avoided when the direction of piston motion has changed. The manufacturing costs decreases since it is not necessary for providing of high precision of guidance a high precision of manufacturing of pistons and cylinders.

In one embodiment of the invention the guides are fixed to the housing, and the followers have a possibility to move axially on the guides. In one alternative embodiment the reverse is true, namely the followers are fixed to the housing, and the guides have the possibility to move axially on the guides.

In another embodiment of the engine according to the present invention the cross section of each cam section is a line arranged at angle of degrees different from 90° in towards the axes of the cam which arrangement ensuring a reaction having radial component from the cam section when contacting the roller, and the radial component direction is directed to the axes of the cam. This radial component leads to discharge of the arms of followers, because it eliminates a part of the moment caused by the axial component of the same total reaction.

In yet another embodiment of the invention the end of each arm is formed as a main bearing journal which free end forms additional bearing journal eccentric disposed compared to the main bearing journal. The roller is mounted on the main bearing journal and an additional roller is mounted on the additional bearing journal, so as the main roller and the additional roller contact with the opposite cam sections of the cam. The additional rollers ensure contact with the opposite cam of the cam section contacting with the main rollers. Thus it prevents the contact between each follower and the cam from interruption when the direction of the loading force has changed. Between the additional bearing journal and the additional roller has elastic element ensuring self-aligning toward the cam sections. In one alternative embodiment of the invention the axes of each arm is a straight line coinciding with the direction of the contact reaction in top dead center of the piston. The end of each arm is formed as a fork, and on fork arms a main bearing journal is immovably mounted, carrying the main roller. The main bearing journal is tube-like shaped, in which hole an additional bearing journal is positioned having axes parallel to the arm, on which additional journal an additional roller is mounted. The additional bearing journal has a possibility for movement on the axes of the main bearing journal, as the main roller and the additional roller each contacts with the one of opposite cam sections of the cam.

In one another embodiment the piston cam engine according to the invention further comprises at least one cylinder head including variable means for delivery and means for discharge of working fluid. Thus the engine may be build in and to operate as compressor or pump.

In one next embodiment of the invention the corrugated cam section is made so that its curve of law of motion of the followers in function of the angle of cam rotation is formed by consecutively alternating ascending and descending sectors in which connection equal number of convexities and concavities are obtained, which total number is equal to or multiple to the sum of the number of arms of the followers. At that the curve is continuous at least up to its second derivative within one complete cam rotation of 360°. Besides the curve is symmetrical for every two adjacent ascending and descending sectors toward a line passing trough its point of junction and the line is perpendicular to the tangent to the curve in this point, as well as the curve is symmetrical toward the middle point of a given ascending or descending sector. This embodiment of the cam curve ensures the velocities and accelerations of the followers at the end of each ascending and descending sector to be equal of their velocities and accelerations in the beginning of the next section, which in its turn leads to achieve a graded junction when the followers change their direction of movement. In one preferred embodiment each ascending or descending sector of the curve has by one maximal and by one minimal value of its second derivative which are displaced from the end points of the given sector. In one more preferred embodiment the values of the second derivative of the curve are equal to zero in the points of connection of each two adjacent sectors. In one most preferred embodiment equal rectilinear sectors are included in the zone of points of connection of the curve. Thus the accelerations are equal by size and adverse by direction when comparing the accelerations of given follower at any two of its positions which are equal remote from the middle point of any ascending or descending sector. Such curve provides a simultaneous contact of all main bearing journals of followers with the respective cam profiles. Thus the piston cam engine according to the invention is completely balance at each working stage.

In one another embodiment the piston cam engine according to the invention comprises more than one drive or driven shaft, each one rotary moved by the cam.

In one next embodiment the drive or driven shaft transmits or accepts motion from the cam by means of chain drive.

The invention further provides a compressor or pump including at least one piston cam engine according to the embodiments described above.

The present invention also provides a motor including the piston cam engine according to the embodiments described above.

In one embodiment the motor is an internal-combustion engine, which valve-timing mechanism includes at least one kinematic chain having one discharge or one inlet cam on its one end and valve on its other end, both connected by a rocker with roller. The roller contacts to the discharge or inlet cam. The discharge or inlet cam is a flat 2D cam fixed coaxially to the main cam of the piston cam engine. The rocker is connected by a hinge to the housing of the engine.

In yet another embodiment the motor is a four-stroke two-piston engine, which valve-timing mechanism consists of four kinematic chains, two of which are discharge and the other two are inlet chains, which kinematic chains are located by two different discharge and inlet chains of each side of the main cam.

In another embodiment the motor is four-stroke one-piston engine, which valve-timing mechanism consists of two kinematic chains, one of which is discharge chain and the other is inlet chain, which kinematic chains are located on the side of the cylinder.

Another embodiment provides a two-stroke two-piston engine, which valve-timing mechanism consists of two kinematic discharge chains located by one of each side of the main cam, and the power supplying with fresh working substance is from windows of each cylinder.

The another embodiment of the invention further provides a motor which is a two-stroke one-piston engine, having valve-timing mechanism consisting of one kinematic discharge chain.

The next embodiment discloses a motor comprising one operating cylinder working at four- or two-stroke process, and one opposite cylinder which is cylinder of compressor or pump. In one preferred embodiment the opposite cylinder is a cylinder of compressor, and at least a part of the compressed air from the compressor cylinder feeds the operating cylinder through a pneumatic accumulator where the air is stored and/or fuel-air mixture is prepared for the next working cycle of the operating cylinder.

In yet another embodiment the motor comprises more than one piston cam engine, each of which represents separate module, and the modules are kinematic connected each other.

BRIEF DESCRIPTION OF THE DRAWINGS

FIGS. 2*a*, 2*b* and 2*c* are three-dimensional views of one two-arm and one three-arm follower and a variant of follower with centering journal which meet the requirements for followers of piston cam engine according to the invention;

DETAILED DESCRIPTION OF THE INVENTION

According to the invention different two- and one-piston engines could be realized that may afterwards be build in compressors, pumps, internal combustion engines performing different working cycles, as well as internal combustion engines combined with a pump or compressor.

Figure 1:
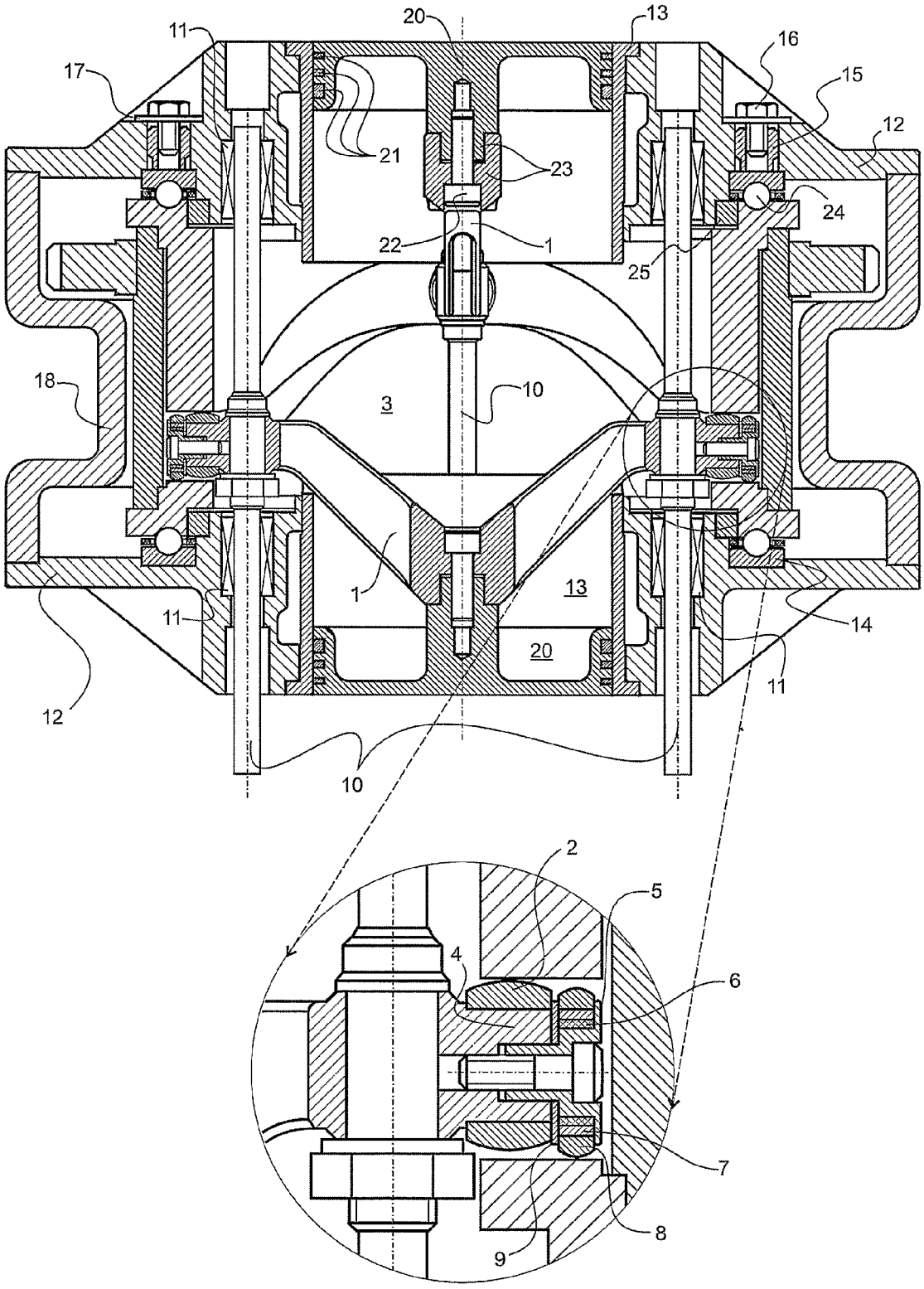
FIG. 1 shows a longitudinal section of piston engine passing through the axes of two opposite guiding columns.

FIG. 1 shows one preferred embodiment of a two-piston cam engine according to the invention. The engine comprises two followers 1 that are monolithic in that case and each one has two arms 26. To their free endings that are formed as main bearing journals 4, main rollers are mounted 2 that are in contact with their corresponding curved sector of main transformation cam 3. Additional bearing journal 5 is attached to the front part of each main bearing journal 4, on which journal 5 elastic element 6, bush in this case, another bush 7 and additional roller 8 are mounted. The additional roller 8 is in contact with the cam curve that is opposite to cam curve the main rollers 2 are in contact. The axes of additional bearing journals 5 are parallel to the axes of their corresponding main bearing journals 4, but they are displaced against them in direction parallel to the axis of given follower in direction to common end of its arms 26. A spacer washer 9 is mounted between each main bearing journal 4 and its corresponding additional bearing journal 5 that prevents the contact between the main roller 2 and additional roller 8 rotating in different directions. Between each arm 26 and its corresponding main bearing journal 4 there is an opening which axis is parallel to the direction of loading force to the respective follower. In these opening there are guiding columns 10 with round cross section in this case. In sown example the connection between the guiding columns 10 and the followers 1 is fixed. Each guiding column 10 on its turn is guided in its two endings by linear bearings 11 placed in housing 12, namely two opposite cylinder blocks. In the blocks 12 there are also opposite cylinders 13 and bearing rings 14. In one of the two cylinder blocks 12 there are screw holes in which binder screws 15 are screwed that are protected against self-unscrewing by means of fixing bolts 16. The bolts 16 are screwed in the corresponding binder screws 15 with reverse threads and are protected against self-unscrewing by means of spring washers 17. The binder screws 15 exert rated pressure on bearing ring 14 of axial bearing 24 and eliminate undesirable axial clearances both in axial bearings 24 and between cam curves and rolling rollers 2 and 8 of followers 1. The cylinder blocks 12 close bilaterally a crankcase 18 by means of threaded joints 19 which could be seen on FIG. 12. In the two operating cylinders 13 there are pistons 20 having compression rings 21. Pistons 20 are fixed to the unitary endings of the arms 26 of each follower by means of bolts 22. In this case pairs of cylindrical locators 23 are used for centering between the followers and pistons 20, connected respectively to the arms 26 of given follower 1 and the rod of the corresponding piston 20. The fit between the pairs of cylinder locators 23 is a guaranteed clearance fit, which gives opportunity each piston 20 for self-adjusting in the corresponding cylinder 13. The contact front parts of the locators 23 could be manufactured so as to ensure parallelism between axes of piston 20 and their corresponding cylinders 13 and do not prevent pistons 2Q self-adjusting. In this particular case the bearing of the cam 3 in the opposite cylinder blocks 12 is frontal by means of axial rolling bearings 24 and radial by means of friction bearings 25. The piston cam engine according to the present invention is suitable for unifying of its units, thus allowing flexibility in the manufacturing of different modifications.

Figure 2A:
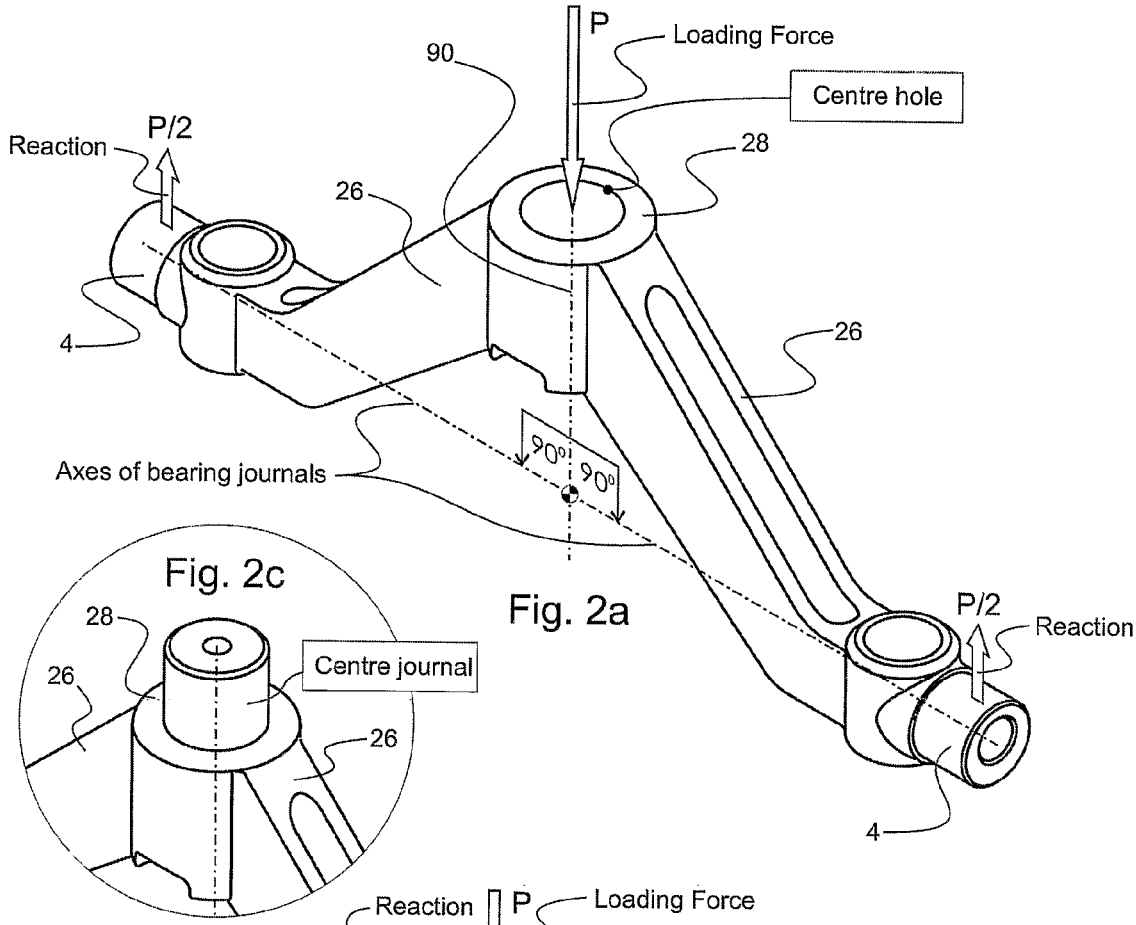
Figure 2B:
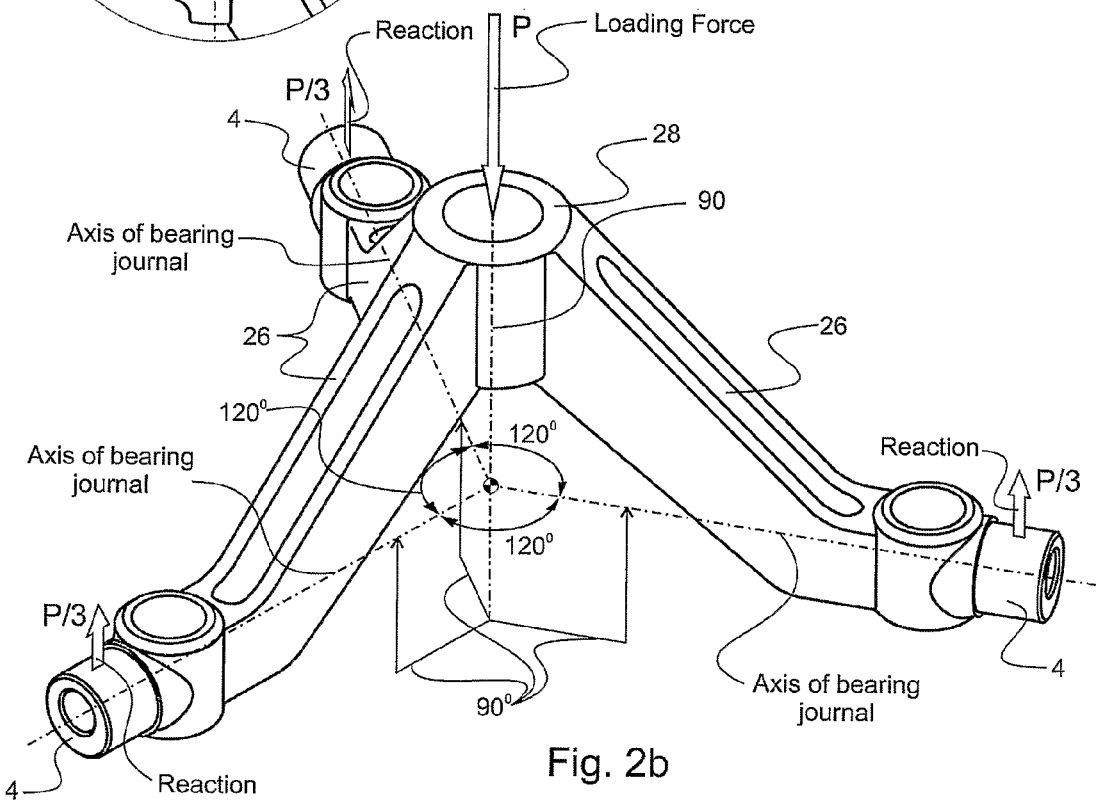

Axonometric views of followers, namely having two and three arms 26 and an example of follower with a centering journal are shown on FIGS. 2*a*, 2*b* and 2*c*. It is typical for the two-arm follower 1 that its axis of symmetry coincides with the axis 90 of loading force to the follower 1. Additional effect from the use of more than two arms 26 for one follower is the increase of the number of contacts between the follower and its respective cam curve which leads to more uniform distribution of summary piston force on the cam curve, reduces its wearing out thus prolonging the piston cam engine life of operation.

Figure 3A:
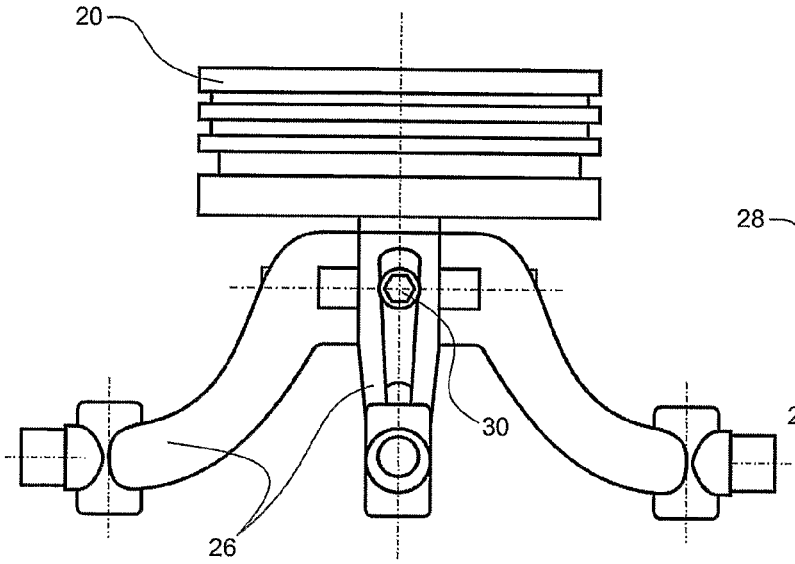
FIGS. 3*a*, 3*b*, 3*c* and 3*d* are respectively views, partial section and auxiliary view of a composite follower.
Figure 3C:
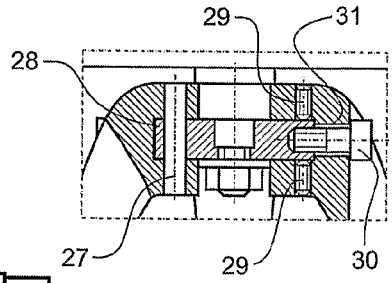
Figure 3B:
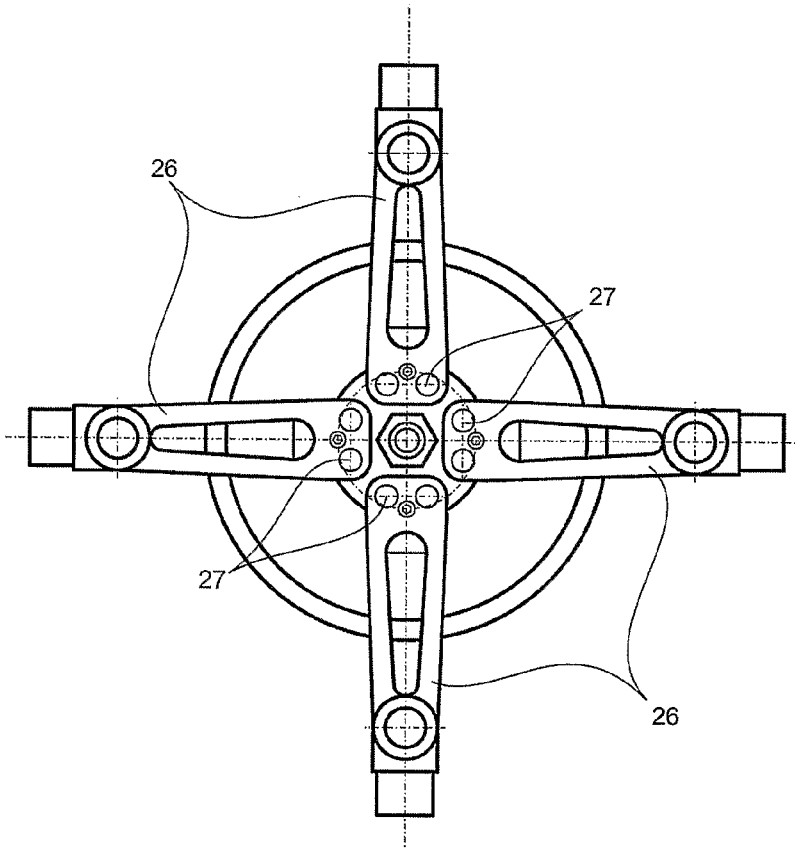
Figure 3D:
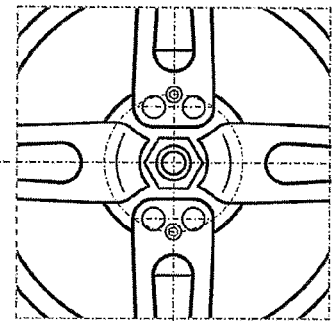

FIGS. 3*a*, 3*b*, 3*c* and 3*d* show respectively views, partial section and auxiliary view of a composite follower 1 having four separate arms 26 twos connected. In the one end of each arm 26 there is a channel with rectangular cross section in which a connector 28 by means of fitting pins 27 is adjusted to the arms 26. The two sides of the channel embrace the front parts of the connector 28. The fitting pins 27 are in parallel to the direction of loading force of the follower 1. Each arm 26 is connected to the connector 28 with two adjusting screws 29 and one retainer screw 30. The fixing screw passes through a reniforme opening 31 of the arm 26 and is screwed in a screw hole of connector 28. This example embodiment allows independent adjustment of the arm 26 position. FIG. 3*d* shows a follower having four arms 26, two of which lying opposite each other together with the connector 28 form a monolithic detail, while the other two arms 26 are connected to the connector 28 as described above. Using composite followers 1 will facilitate their manufacturing in cases when the arms 26 are more than two or when overall dimensions are large.

Figure 4A:
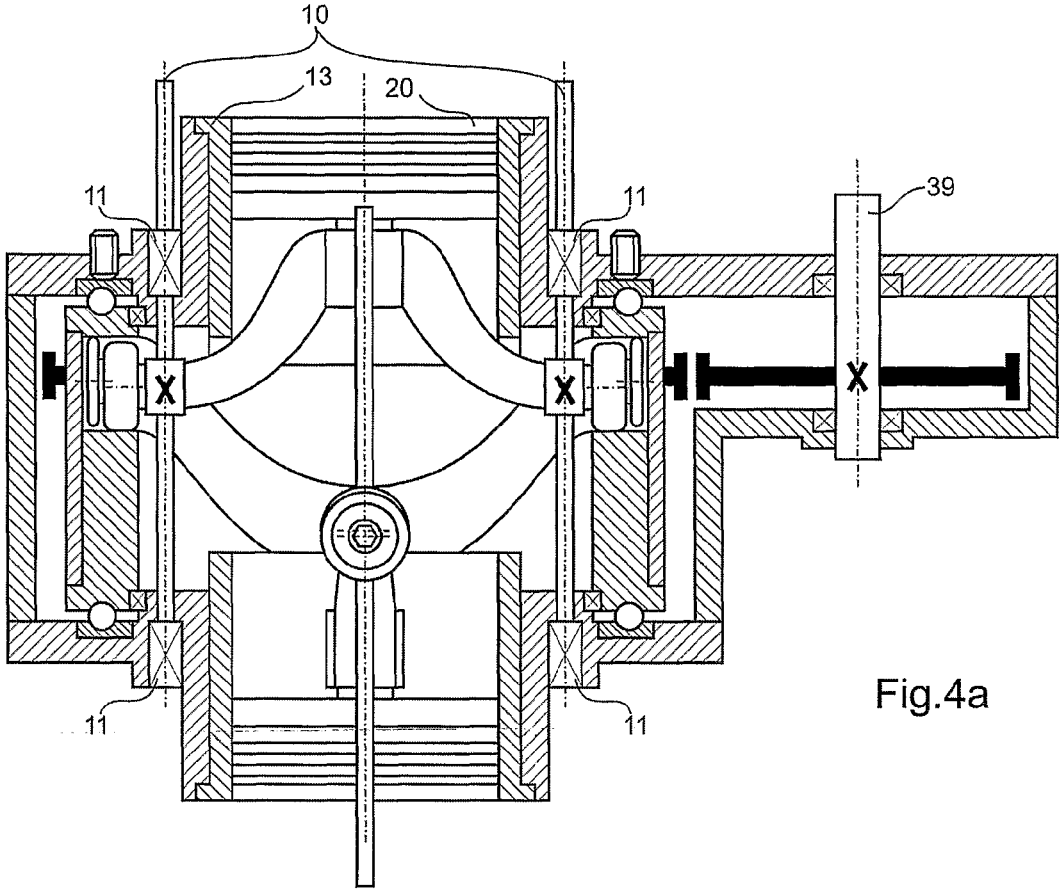
FIGS. 4*a* and 4*b* are two variants for guiding of followers of two-piston cam engine according to the invention.
Figure 4B:
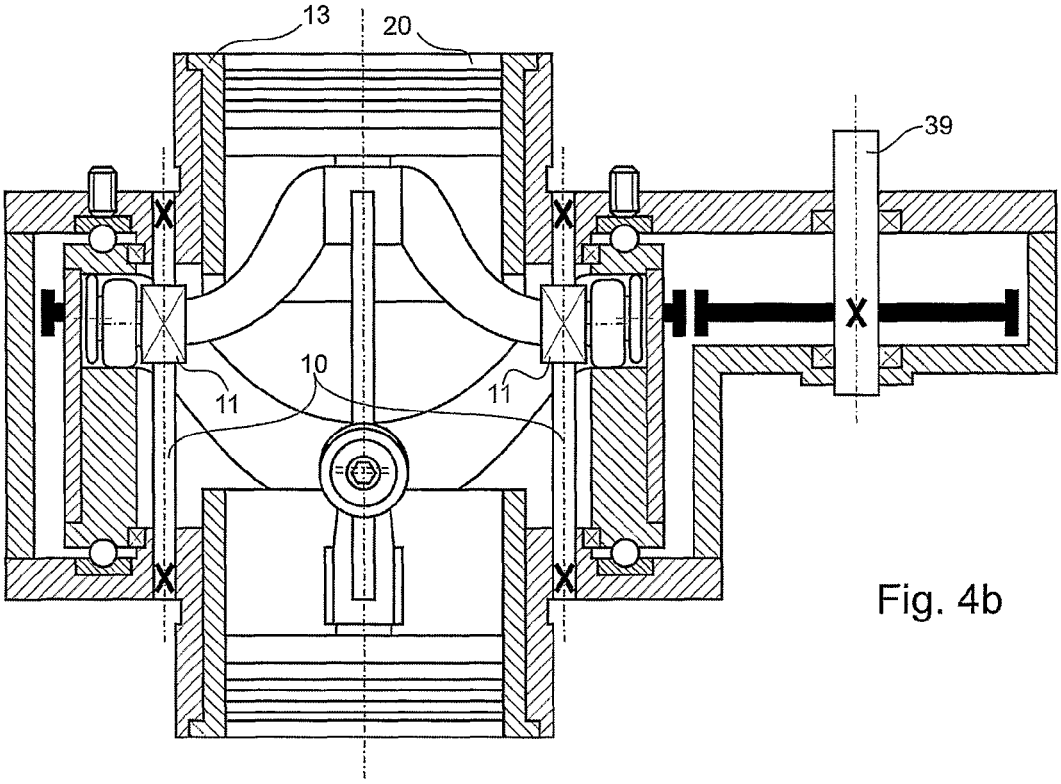

FIGS. 4*a* and 4*b* shows two example embodiments of follower guiding of the piston engine according to the invention. In the first embodiment shown on FIG. 4*a* each column 10 is fixed to its corresponding arm 26, and its connection 11 to the housing is axially-movable. In the second embodiment shown on FIG. 4*b* each guiding column 10 is fixed to engine housing and the connection 11 with its corresponding arm 26 is axially movable. These connections 11 allow reciprocal motion of the followers 1 in parallel to their own lines of loading force. The connections 11 could be made as friction bearing or rolling axial bearings. The fixed connections are shown with "X" on the drawing. The second embodiment of FIG. 4*b* of the disclosed piston engine is preferable in cases when the followers' guiding is reliable, for example guiding of follower having more than two arms.

Figure 5:
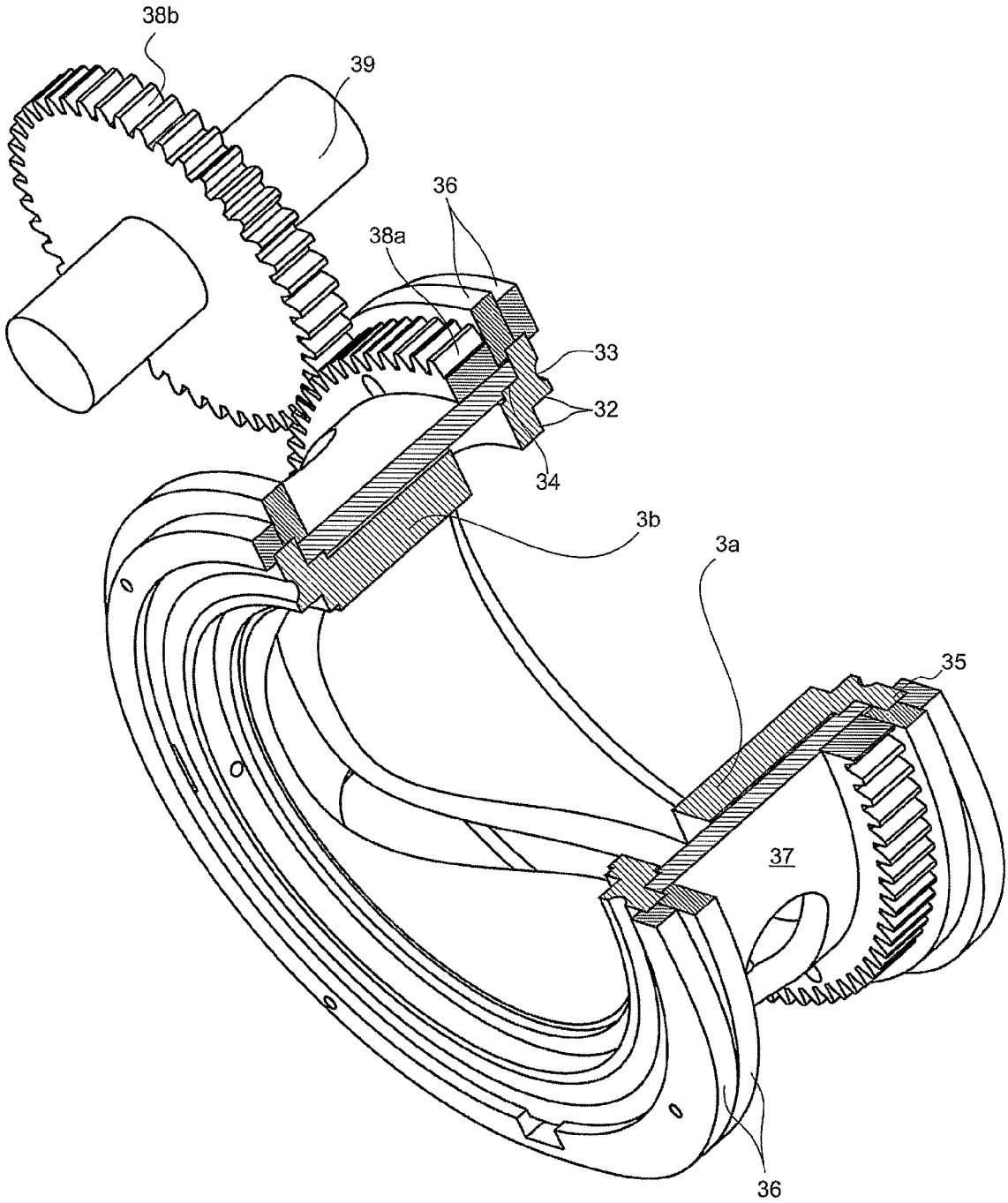
FIG. 5 is an axonometric view of partial section of the main cam and gearing for rotation output or input.

FIG. 5 shows an axonometric view of the cam 3 of the piston cam engine of FIG. 1. This cam 3 comprises two identical cam bushes 3*a* and 3*b*. On one side of these bushes there are cam curves having two concavities and two convexities each and the sum of total number concavities and convexities is equal or multiple to the sum of arms 26 number of the two followers 1. On the other side of each cam bush there is internal ring-shaped cut-out 32 for friction radial bearings 25, semicircular channel 33 for the balls of the rolling axial bearings 24, adjusting ring 34 for orientation of the first cam bush 3*a* against the other one 3*b* and flange 35 for fastening of means for fluid flows control. In this case the means for control are flat 2D cams 36. The axes of cam bushes 3*a* and 3*b* coincide, while their cam curves are turned opposite each other as the convexities of one of the curves are positioned against the concavities of the other one thus forming the cam groove. The reciprocal position of the two cam bushes 3*a* and 3*b* is implemented by means of a spacer 37. In one preferred embodiment the spacer 37 is fixed with one of the cam bushes 3*a*, and its fitting with the other cam bush 3*b* allows axial movement between each other. Thus the cam grove width could be adjusted. FIG. 5 shows a gearing 38, accepting or taking out the rotation. One of the gears 38*a* is fixed to the spacer 37, and the other 38*b* is fixed to a shaft 39 that is placed in engine housing, which could be seen on FIGS. 4*a* and 4*b*.

Figure 6A:
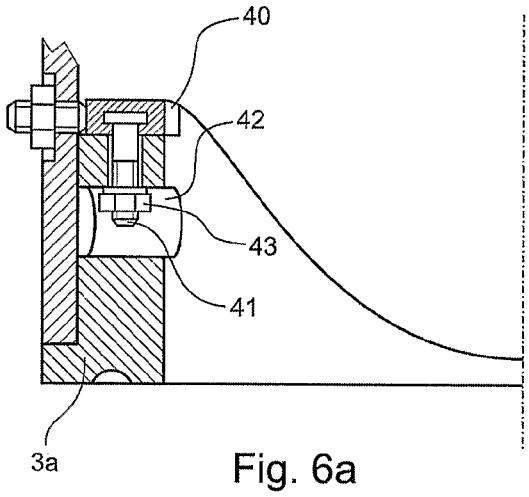
FIG. 6 shows a cam section with plate inserted.
Figure 6B:
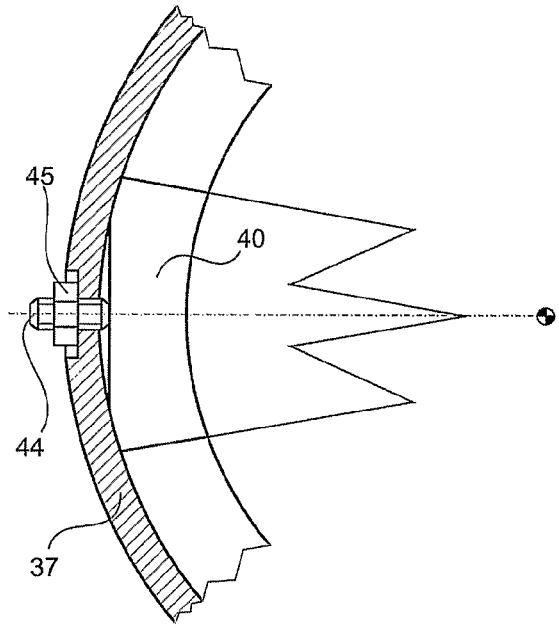

The embodiment shown on FIGS. 6*a* and 6*b* increases the reliability and wear resistance of the main cam 3 of the disclosed piston engine without significantly raising its price. FIG. 6*a* shows a cross section of a cam bush 3*a* or 3*b* passing through its own axis and a point corresponding to one top dead center of the pistons 20. It could be seen that there are plates 40 made of material resistant to high contact pressure, which plates 40 are mechanically fastened on the most loaded parts of the cam profile, which usually are the areas around the top dead centers. In this shown embodiment the plate is fixed together with thread fastening element 41 that passes through an opening into the wall of cam bush 3*a* or 3*b*, parallel to its axis and goes into a recess 42, where by means of a nut 43 the plate 40 is pressed on the lower plane of curve of the bush 3*a* or 3*b*. FIG. 6*b* is a view of one of the cam bushes 3*a* or 3*b* towards its cam profile and in direction of its axis. When mounting the plate 40 is pressed to the spacer 37 by screwed joint of a screw 44 and nut 45. By using of wear-resistant plate 40 the possibility any vacancies between the plate 40 and the main material of the cam bush 3*a* or 3*b* to occur is avoided. The cam bushes according to the invention are chipper than the monolithic, and when the plate 40 is worn out it could be easy replaced with a new one.

Figure 7:
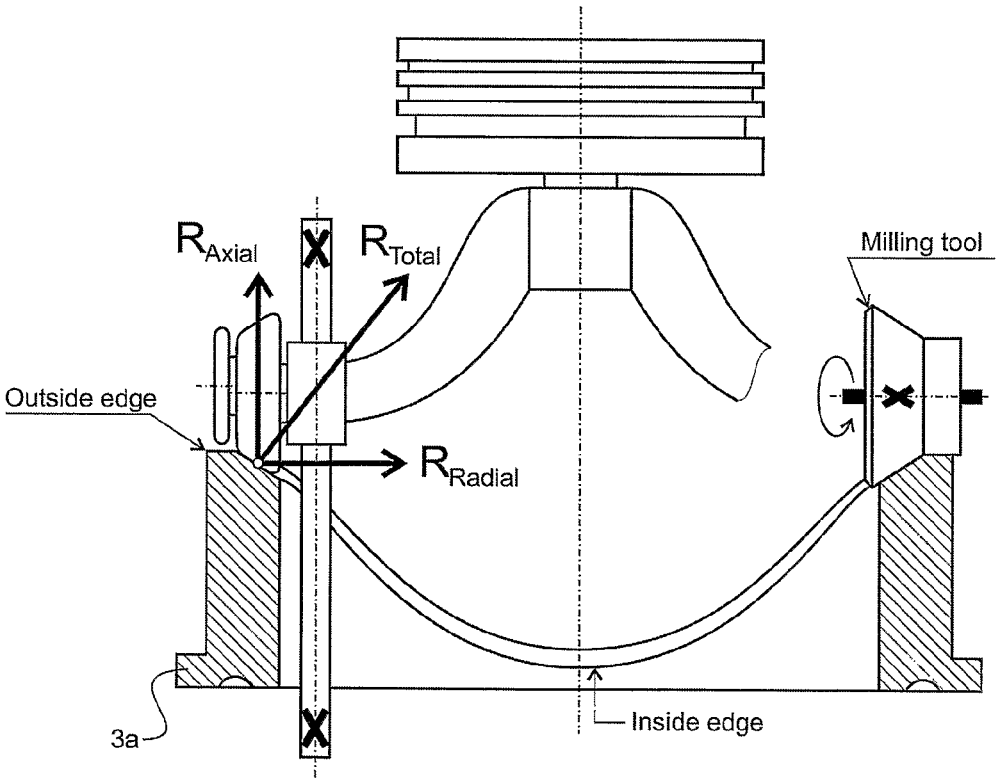
FIG. 7 shows a sloping cam section made radial unloading reaction to the follower.

FIG. 7 shows a sloping cam cross section, creating a radial unloaded reaction to the arms 26' when the cross-section of cam curve has an inside edge 95' lower than the outside 95" one. Thus it is possible to control the direction of the reaction from the cam curve to the arms 26'. The contact area between the cam curve 95 and the main rollers 2' of the arms 26' become wider and it appears a radial component of the reaction from the cam curve 95 to the arm 26'. The expanded contact area reduces its contact pressures in contact surfaces, while the radial reaction unloads the arms 26' of followers 1 by means of the moment created by it that eliminates part of the moment of axial component of the general cam reaction.

Figure 8A:
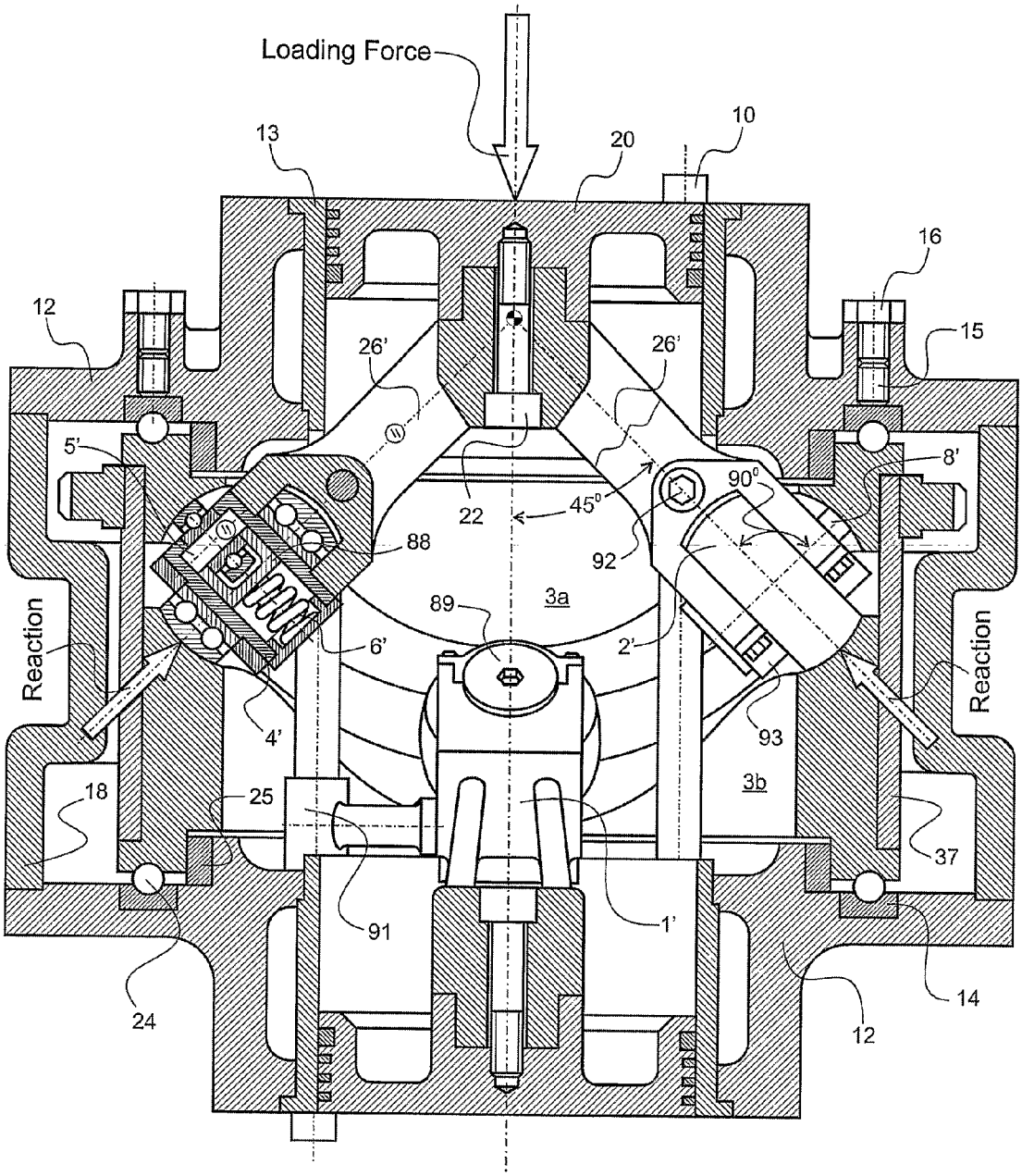
FIGS. 8*a* and 8*b* show respectively longitudinal and cross section of piston engine with modified followers and curvilinear cam section.
Figure 8B:
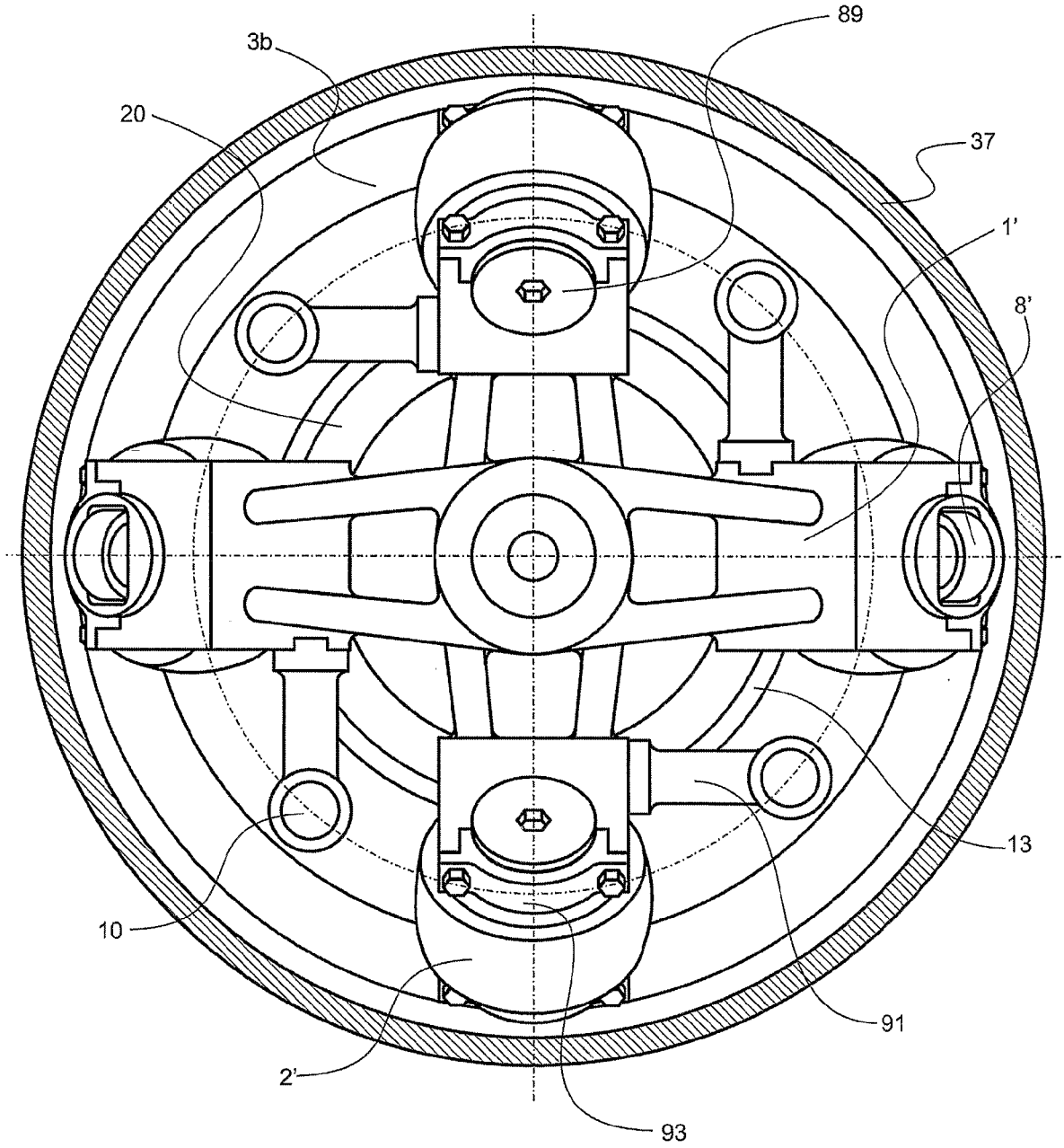

Further opportunity for increasing the loading capacity of followers 1 is shown on FIGS. 8*a* and 8*b* that are respectively a longitudinal and cross section of the described piston engine with modified followers. In the present example the axes of each arm 26' is a straight line coinciding with the direction of contact reaction in top dead center of piston 20. The end of each arm 26' is formed as a fork, in which arms a main bearing journal 4' are fixed, in this case by clamps 93 and threaded joint, on which a main roller 2' is mounted. The main bearing journal (4') is tube-like shaped, in which hole an additional bearing journal (5') is positioned having axes parallel to the arm (26'), on which journal (5') an additional roller (8') is mounted. The additional bearing journal (5') has a possibility for movement on the axes of the main bearing journal (4'), as the main roller (2') and the additional roller (8') each contacts with the one of opposite cam sections (95*a*, 95*b*) of the cam (3). In this case the cam curve of the main cam 3 is composed by a straight horizontal line and an arc, which is the active part of the cam curve. The main rollers 2' in this case have arch-shaped cross section corresponding to the cam curve with which the rollers 2' are in contact with. Roller 8' contacts with the cam curve as the additional bearing journal 5' is pressed by means of plunger 88 and spring 6' leaning on cap 89. A connecting element 91 binds the followers 1 and the guiding columns 10. The main advantage of the disclosed embodiment is that the loading forces to the arms 26' provoke mainly compression loads in the arms, but not buckling or torsional loads which lead to metal fatigue.

Figure 9:
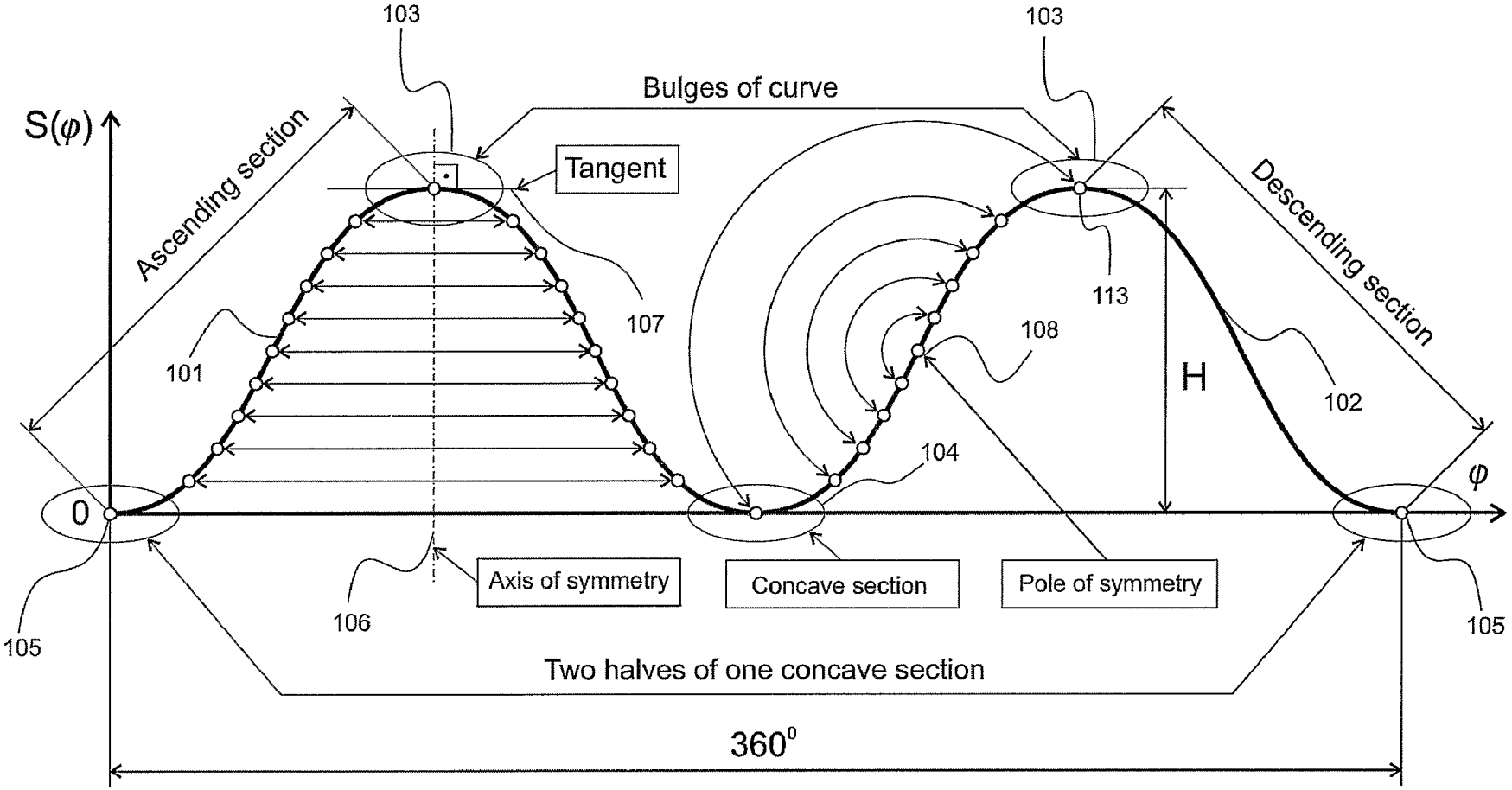
FIG. 9 shows the properties of the law of movement of the followers.

FIG. 9 shows a preferred cam law motion of followers in development. Total number of concavities and convexities of law curve corresponds to the total number of arms of the two followers in examples of FIG. 1, FIG. 4 and FIG. 5, and in this case is four. It is shown also symmetry between each two adjacent sectors and symmetry of points inside each ascending 101 and descending 102 sector against its middle point.

Figure 10:
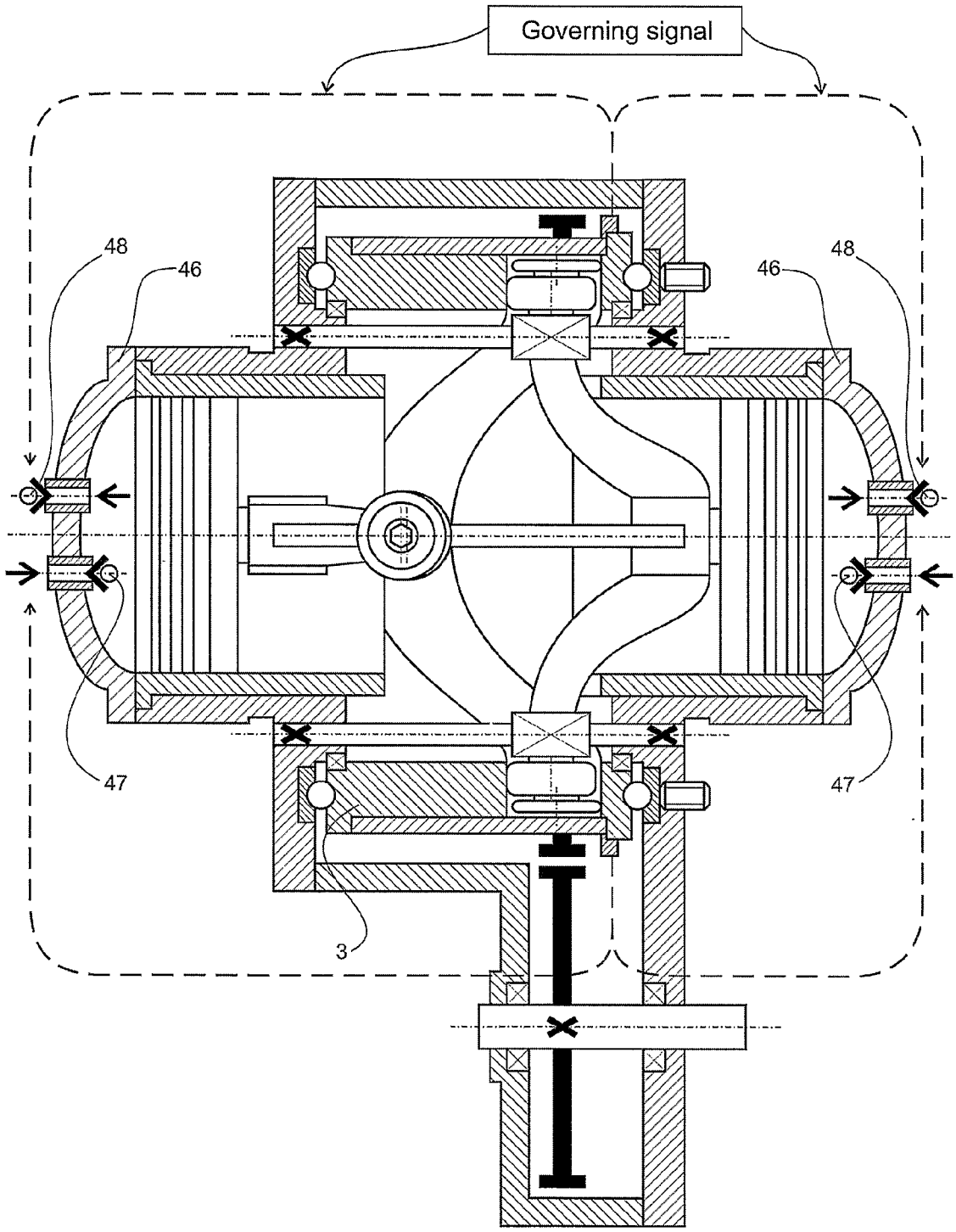
FIG. 10 is a two-piston cam compressor.

FIG. 10 shows a two-piston cam compressor or pump, where to the described piston cam engine a cylinder head 46, comprising means 47 and 48 for supply and discharge of fluid.

Figure 11:
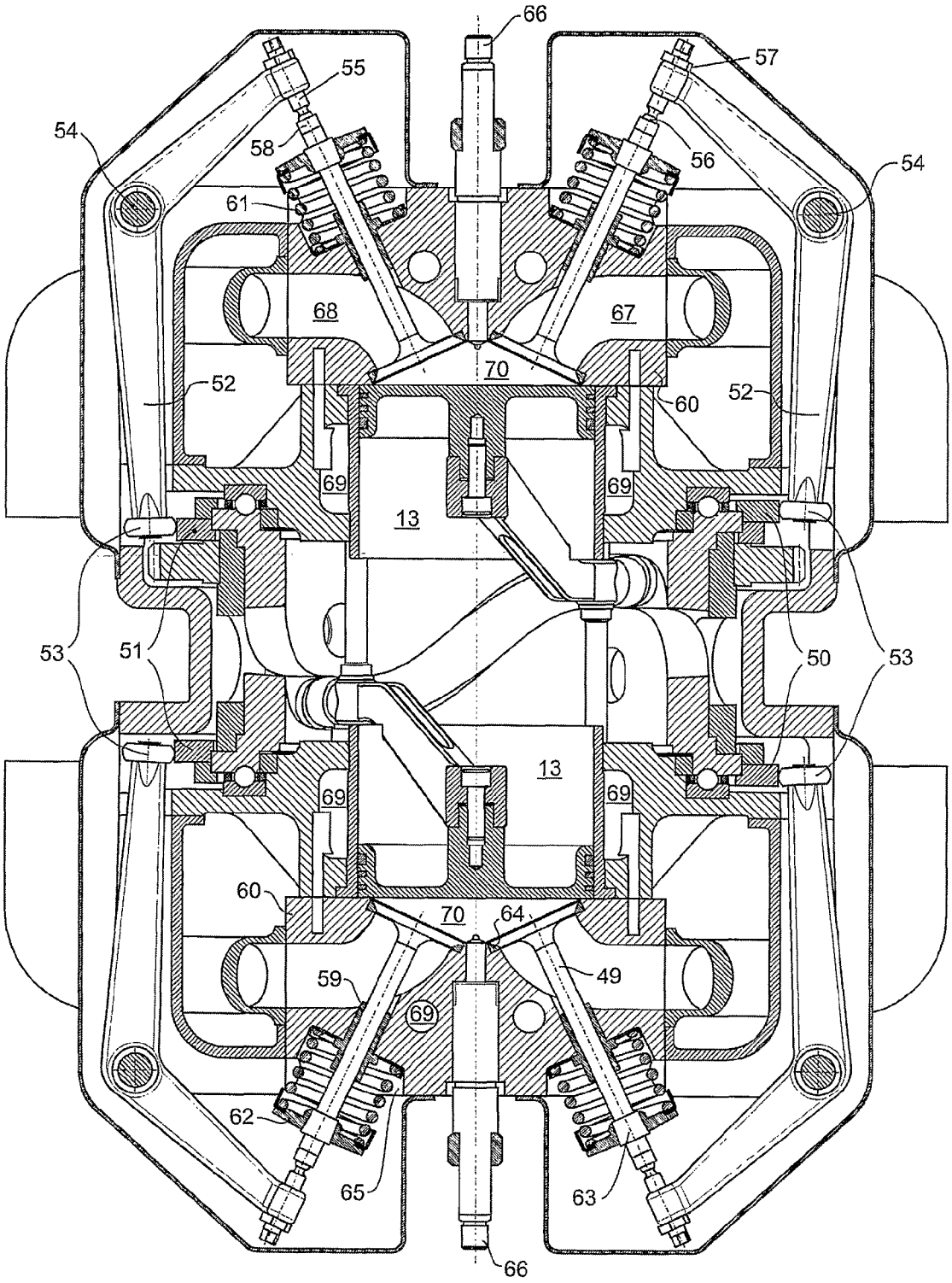
FIG. 11 represents a longitudinal section of two-piston four-stroke internal combustion cam engine passing through the axes of the valves and its main cam.

The adapting of the piston cam engine according to the invention to a four-stroke internal combustion engine is shown on FIG. 11. The valve timing mechanism comprises at least one kinematic chain, four in this case, each of them having valve 49 at one of its end, as well as one discharge 50 or one inlet 51 cams at the other end, connected together by means of rocker 52 having roller 53. The discharge 50 or inlet 51 cam is a flat 2D cam, which is fixed coaxially to the main cam 3 of the piston cam engine. The rocker 52 is connected by a hinge 54 to the housing of the engine. The valve 49 is connected to the rocker 52 by adjusting screw 55 having spherical end piece 56 secured by nut 57. Between each adjusting screw 55 and the front part of the stem of the respective valve 49 there is a cylindrical pad 58 for preserving the reliable contact between adjusting screws 55 and valves 49 when disturbing the parallel position of their axes during valves operation. The valves are driven by guiding bushes 59 positioned in two cylinder heads 60, which tightly close the working cylinders 13. The valves shown on FIG. 11 make by known manner an additional sealing contact with their adjacent cylinder heads by means of preliminary tightening of return springs 61 connected with their respective valves 49 by means of valve disk 62 and binary conic bushes 63. There is a sealing conic bush 64 between each valve 49 and cylinder head 60. Seats 65 for return springs 61 have been formed in cylinder heads 60, as well as openings 66 for nozzles, channels 67 and 68 for working fluid inlet and outlet port, spaces 69 for circulation of the cooling fluid, and combustion chambers 70.

Figure 12:
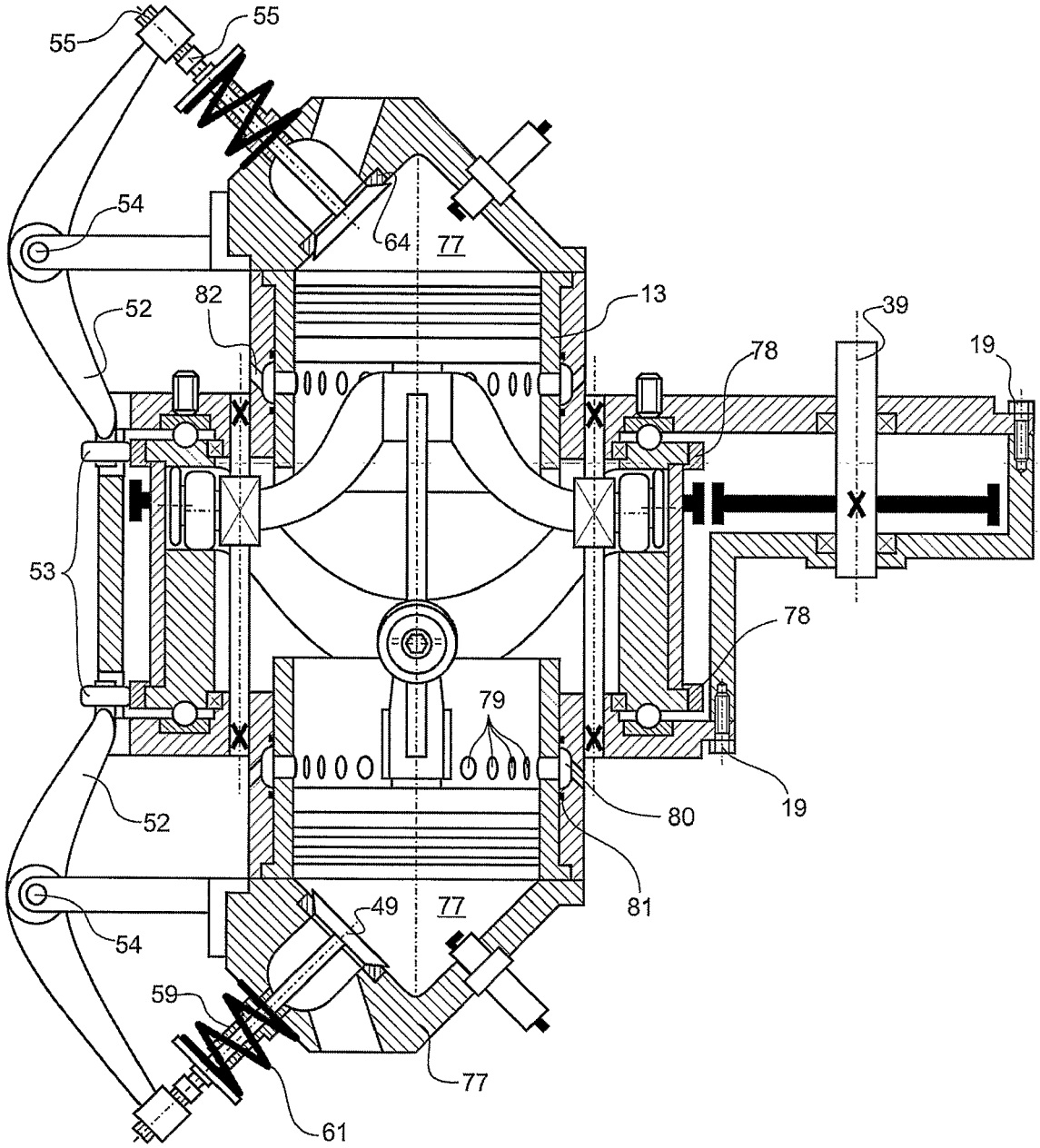
FIG. 12 shows two-piston two-stroke internal combustion cam engine.

FIG. 12 shows a two-piston two-stroke internal combustion engine comprising the cam engine according to the invention. In that particular case there do two cylinder heads 77 and a valve timing mechanism having two kinematic chains, each of them comprise one discharge cam 78. The supply of fresh working medium is carried out by means of windows 79 made on each cylinder 13 in the places corresponding to the bottom dead center of the pistons. Each of the cylinder blocks has internal ring gaps 80 and seals 81 around the windows 79. These ring gaps 80 are supplied with fresh working medium, which pressure is higher than the pressure of the working fluid in the supplied cylinder, when its windows start to open. The air inlet to the ring gaps 80 becomes possible through openings 82 in cylinder blocks.

Figure 13A:
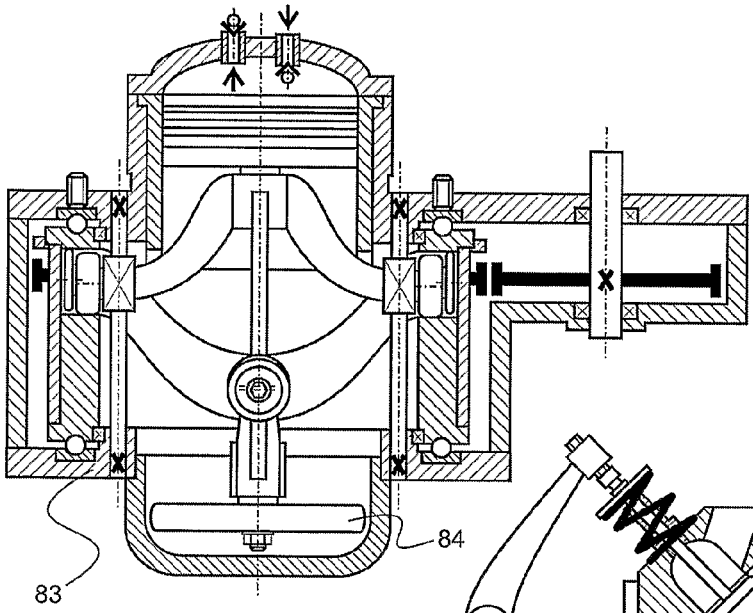
FIGS. 13*a*, 13*b* and 13*c* show respectively one-piston compressor, one-piston four-stroke engine and one-piston two-stroke engine according to the invention.
Figure 13B:
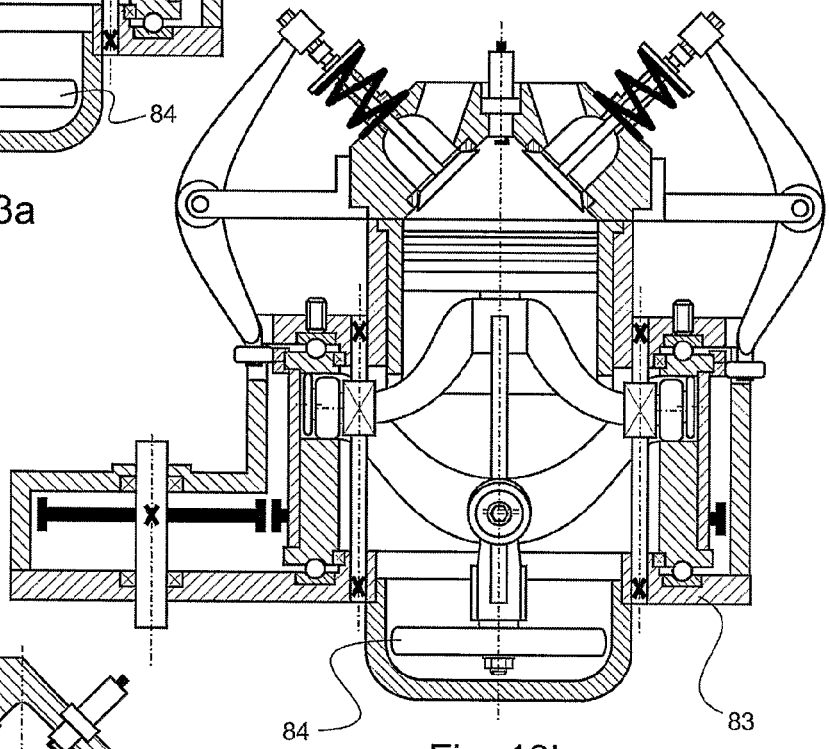
Figure 13C:
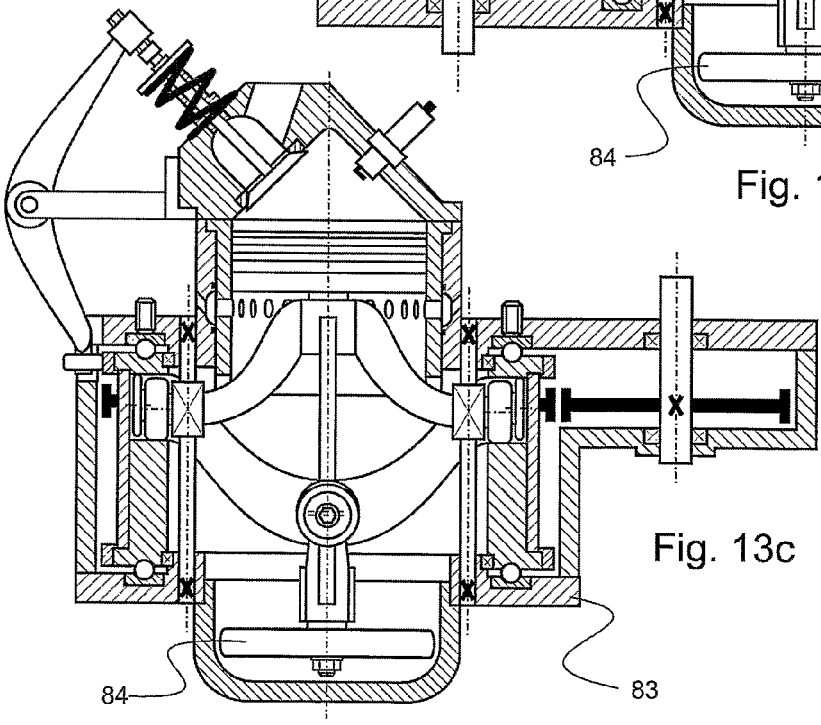

FIGS. 13*a*, 13*b* and 13*c* show respectively a single-piston cam compressor, a single-piston four-stroke cam engine and a single-piston two-stroke cam engine are shown according to the invention. All of them are made on the basic of the piston cam engine shown on FIG. 4*b*. Each one of them has been developed after changing one of its pistons and the corresponding cylinder with a balancer 84. The cylinder block of the removed cylinder has been replaced with a closing cover 83. The single-cylinder cam engines of FIG. 13 are more economical. They are useful for small working volumes and where the requirement for steadiness of engines operation is not always high. Besides they are convenient for the purposes of research and experimental activity. It is easy to transform them into the two-piston cam engine described above.

Figure 14A:
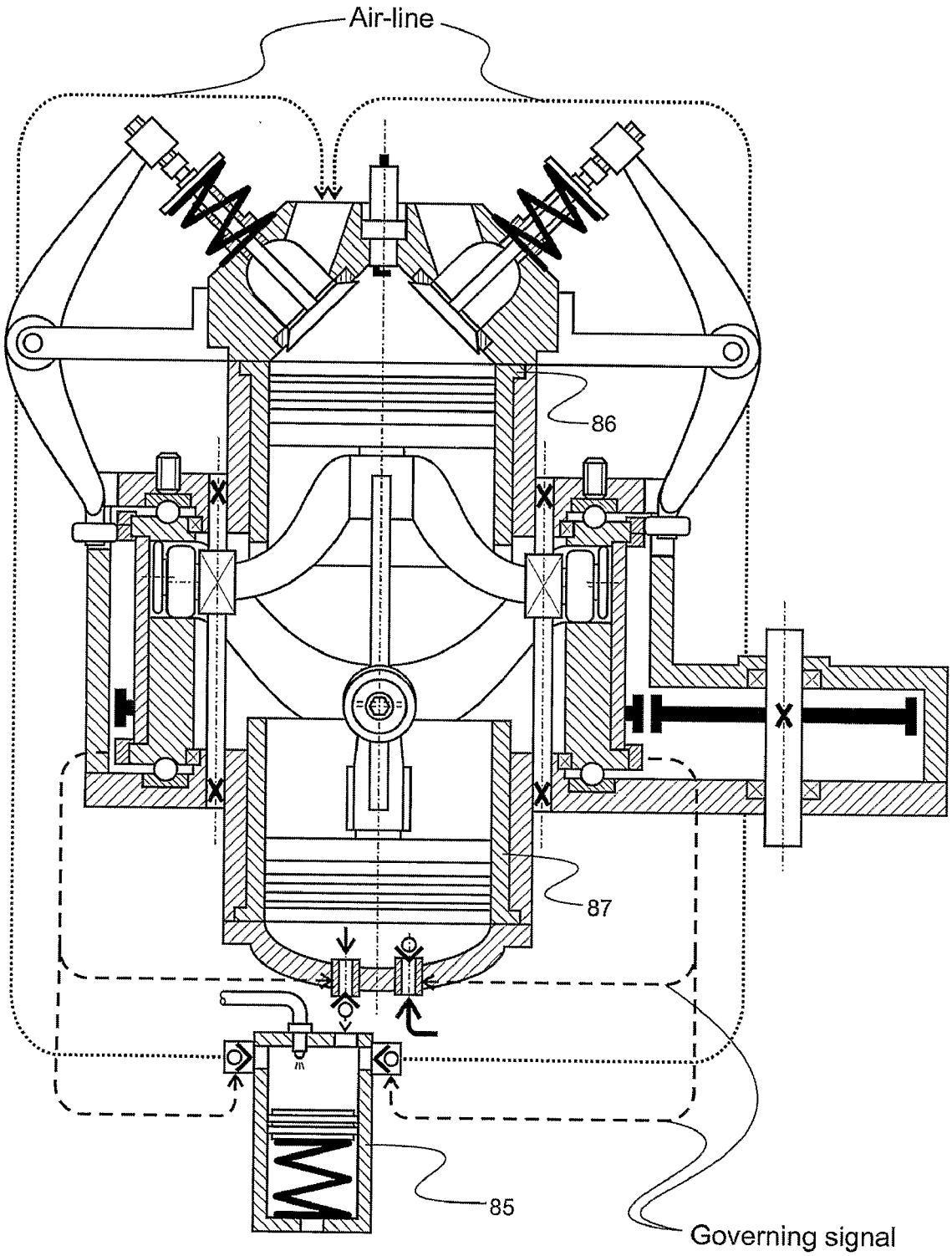
FIGS. 14*a* and 14*b* show respectively four- and two-stroke engine combined with a compressor.
Figure 14B:
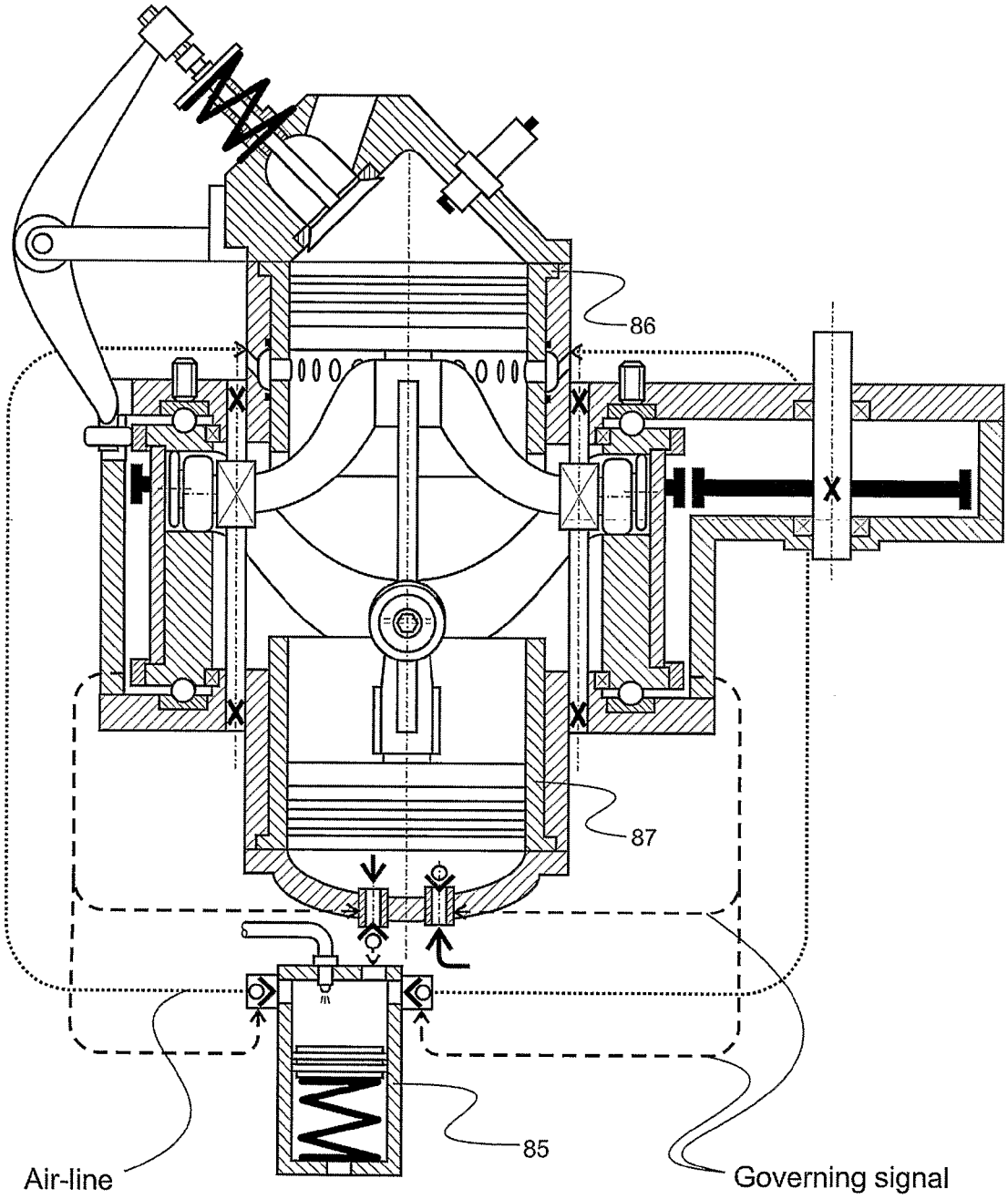

FIGS. 14*a* and 14*b* show different embodiments of combined two-piston cam engine with a compressor. FIG. 14*a* refers to a four-stroke engine, and FIG. 14*b*—to a two-stroke one. Each of the shown embodiments comprises compressor cylinder 87 having means 47, 48 for supply and discharge of working fluid. The differences between them are connected with their energy-supplying cylinders 86. In both cases it is shown, that at least a part of the compressed air from the compressor 87 is directed to the operating cylinders 86 for enrichment of the fuel mixture, as a pneumatic accumulator 85 is provided for storage and air or fuel-air mixture supplying for the next thermo-dynamic cycle. This embodiment is suitable in the cases when the consumer needs mechanical and pneumatic energy at one and the same time and when the steadiness of rotation moment of the outlet shaft is not an important factor.

Figure 15A:
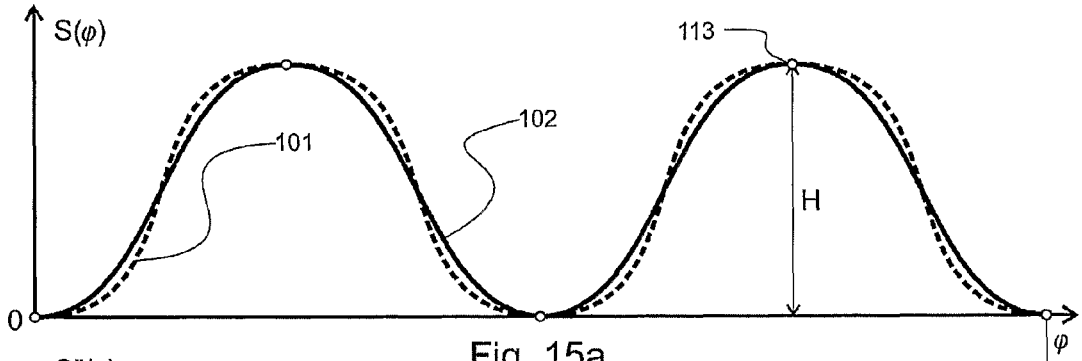
FIGS. 15*a* and 15*b* show respectively two laws of followers movement and their second derivatives that are continuous and which extreme values do not coincide with the end points of their sectors.
Figure 15B:
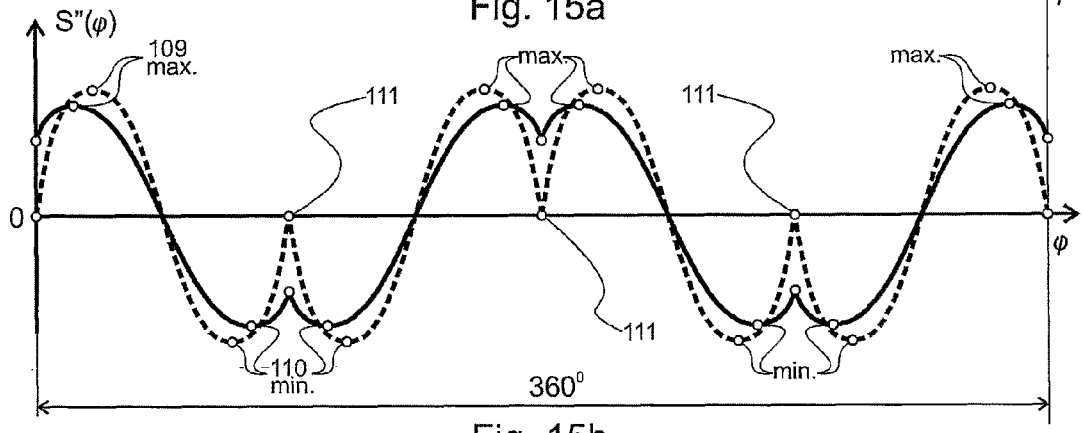

The efficiency of cam engines could be increased by improvement the cam law motion, as it is shown on FIGS. 15*a* and 15*b*. The first drawing on FIG. 15*a* shows two cam laws motion with different degree of retardation of their pistons around their dead centers. Their corresponding second derivatives are given on FIG. 15*b* below. It is evident from this drawing that each sector of the law, irrespective of the fact whether it is ascending 101 or descending 102 one, is characterized with one explicitly expressed maximum 109 and one explicitly expressed minimum 110 of its second derivatives or the same but in reverse sequence (minimum-maximum), which do not coincide with the end points 113 of the section to which they belong. The second derivative, represented with a continuous line, differs by that its values 111 in the ends of each section equal to zero. The continuity of the second derivative of the cam law leads to smooth movement of followers.

Figure 16A:
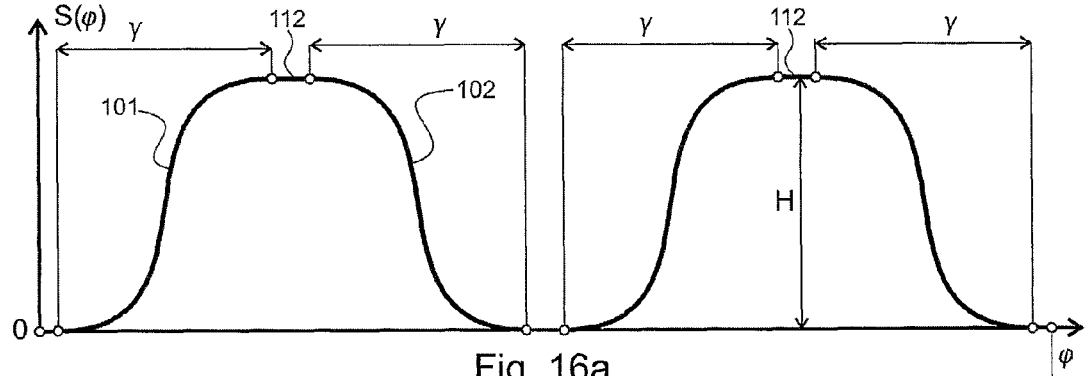
FIGS. 16*a* and 16*b* show a law of follower's movement and its second derivative with introduced rectilinear horizontal sectors in each point of the curve corresponding to pistons dead position.
Figure 16B:
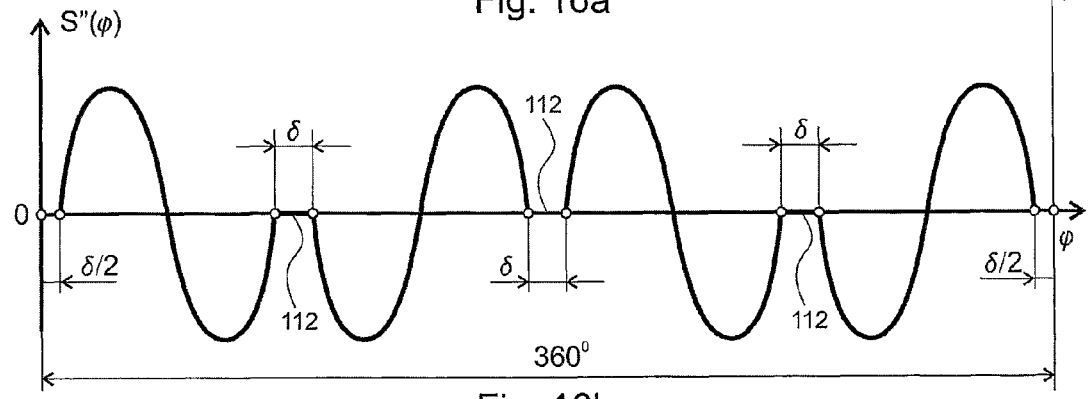

In the following FIGS. 16*a* and 16*b* a cam law motion and its second derivate are shown. In the law curve equal rectilinear sections 112 are integrated in each point, which corresponds to the dead centers of the pistons. On FIG. 16*a* it is shown that the second derivate is continuous, without of interruption, because the values of the second derivative in the ends of each ascending 101 and descending 102 sectors equal to zero. One example of cam law motion as cycloid function is represented on FIG. 16*a*.

$$S(\varphi) = H \cdot \left[\frac{\varphi}{\gamma} - \frac{1}{2 \cdot \pi} \cdot \sin\left(2\pi \frac{\varphi}{\gamma}\right)\right],$$

through which the ascending and descending sectors of the cam law motion may be presented, where $\phi$ is the angle of cam rotation 3, $S(\phi)$ is the cam law motion, H is the piston stroke and $\gamma$ is the angle of cam rotation 3, within which the piston 20 realizes its stroke. For the given example, pistons 20 perform four strokes per one revolution of the cam 3 and four times are immovable keeping constant cylinder volume, each time in the course of $\delta$[deg CrAng]. The relation between $\gamma$ and $\delta$ may be presented by means of the following equation:

$$4\delta + 4\gamma = 360°.$$

The specific forms of the cycloid function for each ascending 101 and descending 102 sector of the law are given in the table below, as well as the introduced rectilinear horizontal sections 112.

| Type of Section | Range of Section | Law of Section |
|---|---|---|
| 1. Rectilinear | $0 \le \varphi \le \frac{\delta}{2}$ | $S(\phi) = 0$ |
| 2. Ascending | $\frac{\delta}{2} \le \varphi \le \gamma + \frac{\delta}{2}$ | $S(\varphi) = H \cdot \left[\frac{\varphi - \frac{\delta}{2}}{\gamma} - \frac{1}{2 \cdot \pi} \cdot \sin\left(2\pi \frac{\varphi - \frac{\delta}{2}}{\gamma}\right)\right]$ |
| 3. Rectilinear | $\gamma + \frac{\delta}{2} \le \varphi \le \gamma + \frac{3}{2}\delta$ | $S(\phi) = H$ |
| 4. Descending | $\gamma + \frac{3}{2}\delta \le \varphi \le 2\gamma + \frac{3}{2}\delta$ | $S(\varphi) = H - H \cdot \left[\frac{\varphi - \gamma - \frac{3}{2}\delta}{\gamma} - \frac{1}{2 \cdot \pi} \cdot \sin\left(2\pi \frac{\varphi - \gamma - \frac{3}{2}\delta}{\gamma}\right)\right]$ |
| 5. Rectilinear | $2\gamma + \frac{3}{2}\delta \le \varphi \le 2\gamma + \frac{5}{2}\delta$ | $S(\phi) = 0$ |
| 6. Ascending | $2\gamma + \frac{5}{2}\delta \le \varphi \le 3\gamma + \frac{5}{2}\delta$ | $S(\varphi) = H \cdot \left[\frac{\varphi - 2\gamma - \frac{5}{2}\delta}{\gamma} - \frac{1}{2 \cdot \pi} \cdot \sin\left(2\pi \frac{\varphi - 2\gamma - \frac{5}{2}\delta}{\gamma}\right)\right]$ |
| 7. Rectilinear | $3\gamma + \frac{5}{2}\delta \le \varphi \le 3\gamma + \frac{7}{2}\delta$ | $S(\phi) = H$ |

-continued

| Type of Section | Range of Section | Law of Section |
|---|---|---|
| 8. Descending | $3\gamma + \frac{7}{2}\delta \le \varphi \le 4\gamma + \frac{7}{2}\delta$ | $S(\varphi) = H - H \cdot \left[\frac{\varphi - 3\gamma - \frac{7}{2}}{\gamma} - \frac{1}{2 \cdot \pi} \cdot \sin\left(2\pi \frac{\varphi - 3\gamma - \frac{7}{2}}{\gamma}\right)\right]$ |
| 9. Rectilinear | $4\gamma + \frac{7}{2}\delta \le \varphi \le 4\gamma + 4\delta$ | $S(\phi) = 0$ |

Figure 17B:
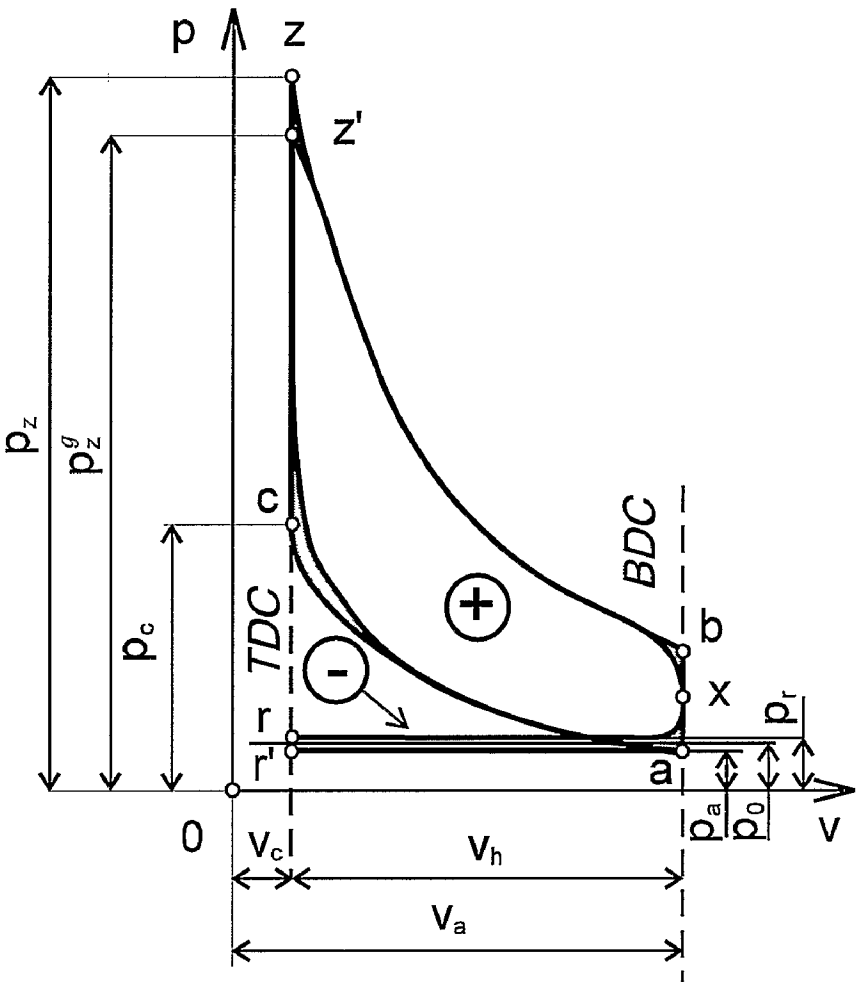
FIGS. 17*a* and 17*b* show thermodynamic cycle respectively of a traditional four-stroke diesel engine and of a cam four-stroke diesel engine according to the invention.
Figure 17A:
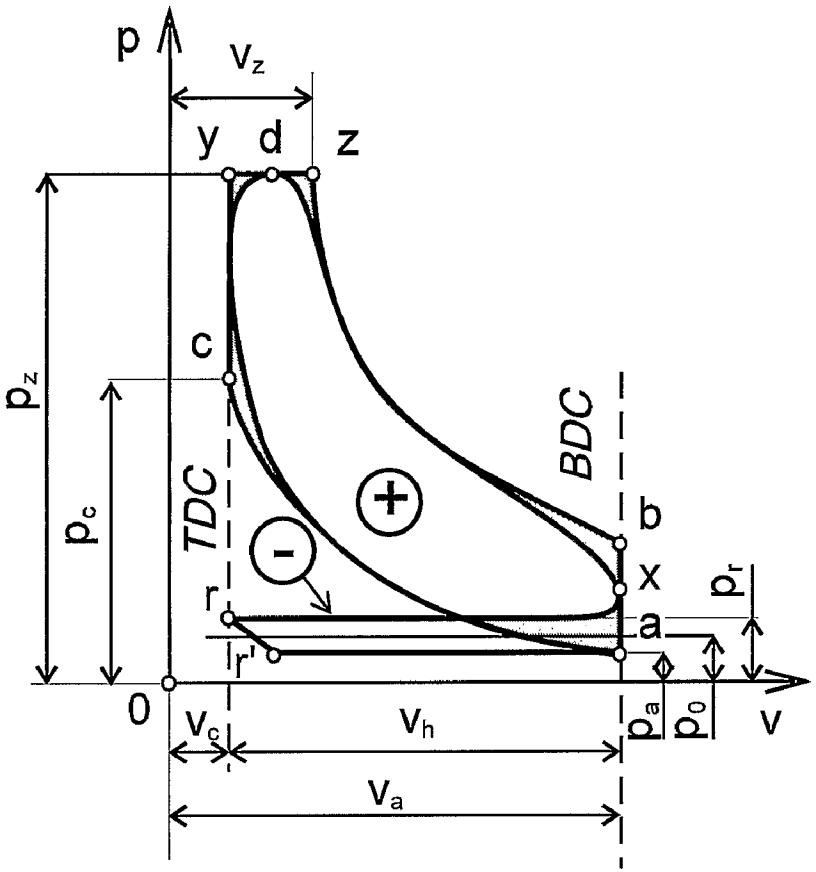

Diagrams p-V (pressure-volume) of two diesel engines are shown on FIGS. 17*a* and 17*b*. The first diagram on FIG. 17*a* corresponds to a diesel engine, having a conventional crank mechanism, and the second diagram on FIG. 17*b* corresponds to a cam law according to the invention. The effective operation of the cam engine is greater than that of traditional engine, due to the fact that in the case of cam engine the heat is brought into in almost constant cylinder volume, and its negative work for the change of the waste gases with fresh working medium is lower than that of traditional diesel engine, which again is due to the fact that around the dead centers and mostly in the bottom dead center, the pistons of the cam engine described may significantly reduce their velocity and even stop for a while.

Figure 18:
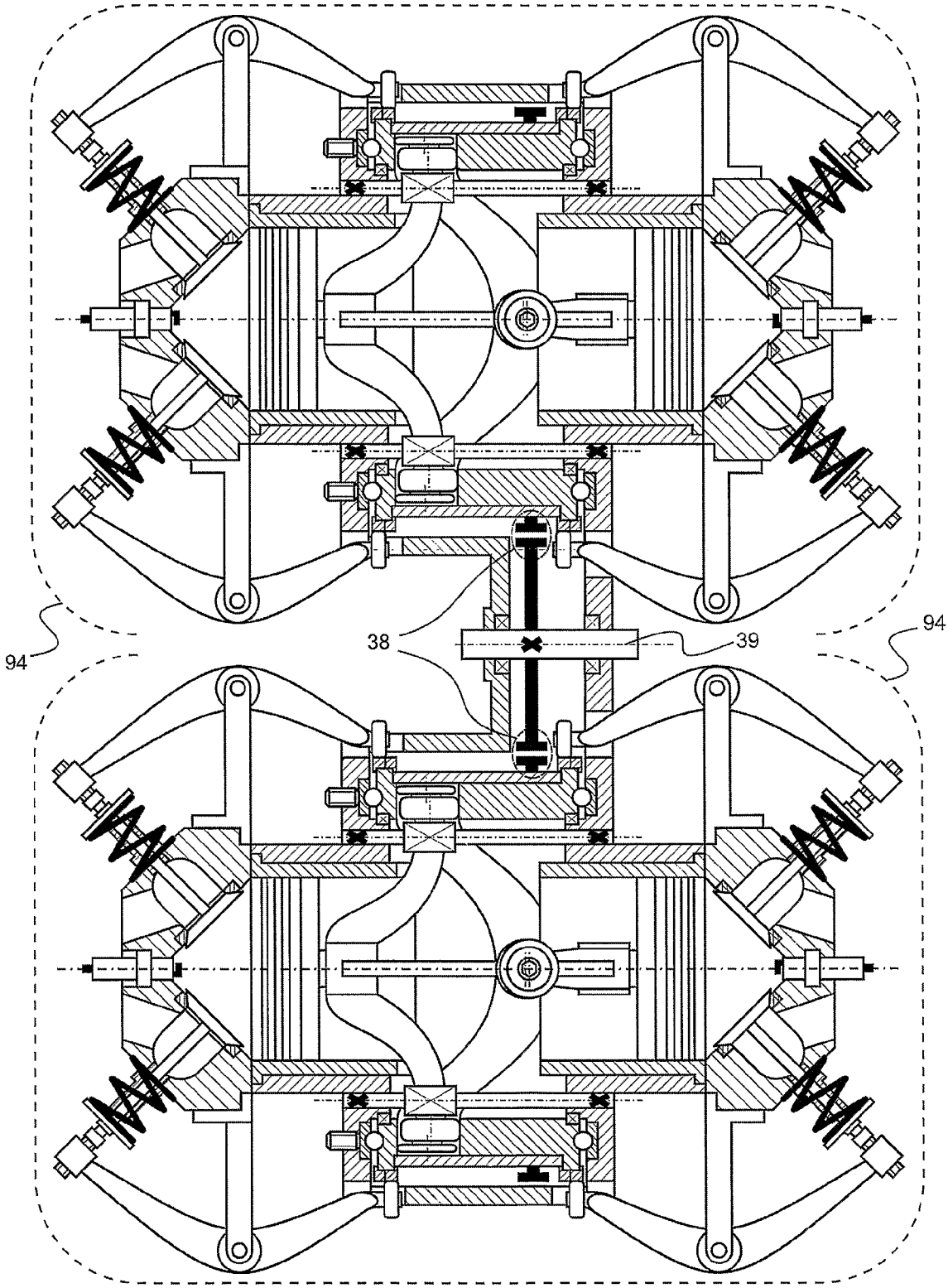
FIG. 18 shows internal combustion engine composites of two modules.

FIG. 18 shows engine composed of two modules 94, and each module 94 is a two-cylinder four-stroke. The connection between the modules 94 is performed by outlet gearing 38.

Figure 19:
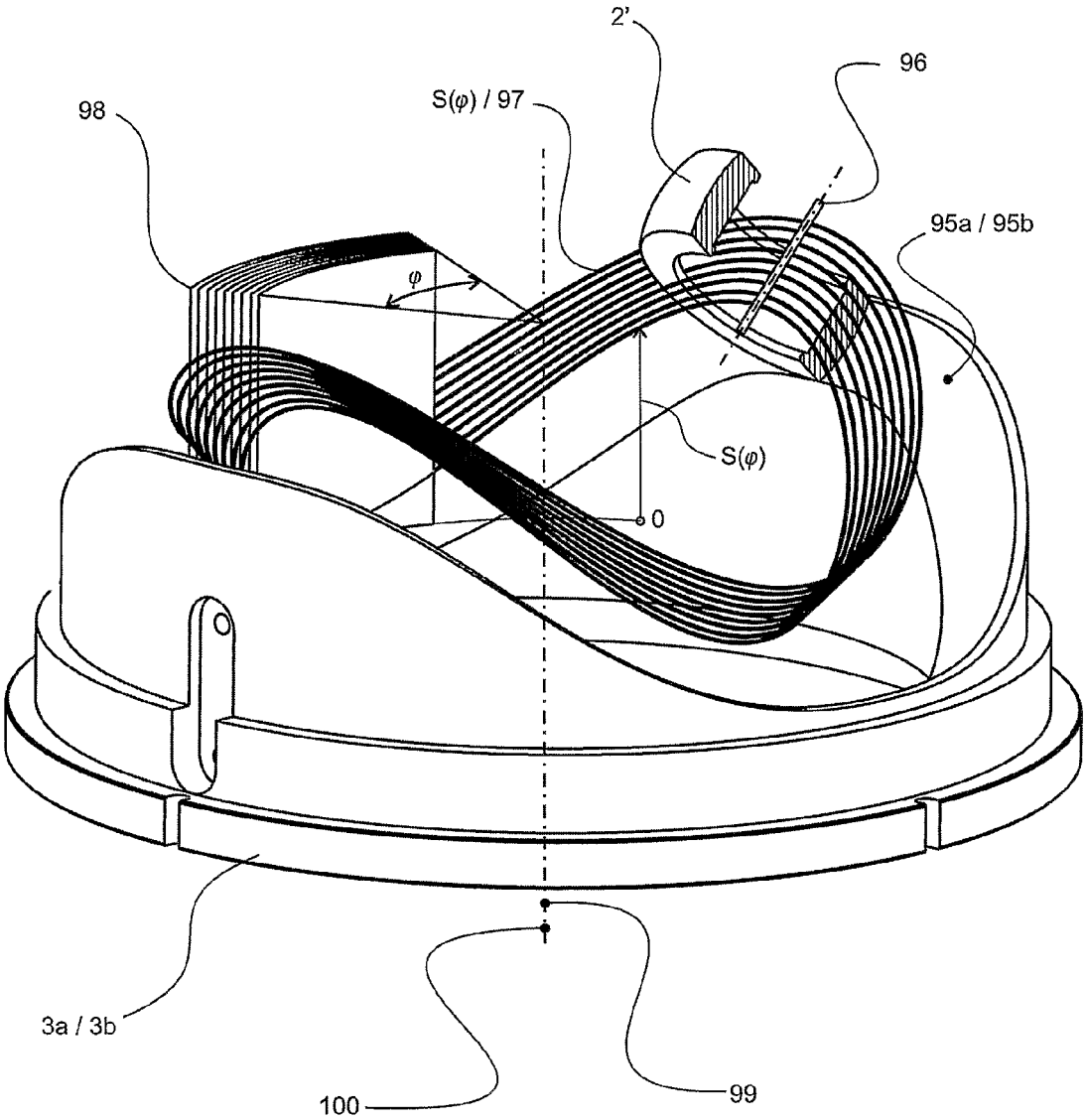
FIG. 19 shows the connection between the shaping of the cam sections and the law of piston motion.

FIG. 19 shows the connection between the cam law motion and the shaping of the cam curves. It is shown the geometry of treating cutter movement where each of 3D curves 97, involved by the points of the axes 96 of the cutter, lie on the cylindrical surfaces 98, which axes 99 coincide with the cam axis 100. The curves 97 represent the piston law motion S(ϕ) depending on the angle of cam rotation. As a result of the above, each cam curve 97 will correspond to the curve of FIG. 9.

Although the description above contains many specifics, these should not be construed as limiting the scope of the invention but as merely providing illustrations of some of the presently preferred embodiments of this invention. Thus, the scope of this invention should be determined by the appended claims and their legal equivalents.

The invention claimed is:

1. Piston cam engine comprising a housing, a drive or driven shaft (39), a cylindrical tubular 3D cam (3) having a cam groove on the inner cylindrical surface, at least one cylinder (13), a first piston (20) moving in the cylinder (13) and a second piston (20) moving in another cylinder (13) or a balancer (84) of the first piston (20) moving in the housing, at least two guides (10) for linear reciprocal motion of the first piston (20) and for the second piston (20) or the balancer (84), two followers (1) having at least two arms (26), one follower of said two followers being connected to the first piston (20) and another follower of said two followers being connected to the second piston (20) or the balancer (84), and the at least two arms of said two followers (1) are equally placed compared to the axes of power transmission (90), as well as rollers (2) for moving in the cam groove and mounted on the ends of the arms (26), characterized by the fact that:

the guides (10) are guide columns, parallel and equally placed compared to the axes of the cam (3);

the cam (3) is composed and comprises two coaxial bushes (3*a*, 3*b*), each one having corrugated cam section (95*a* or 95*b*) from its one side and flange (35) from its other side, besides the bushes (3*a*, 3*b*) are positioned against each other with its corrugated ends in such a way that the convexities of one (3*a*) of the cam sections are positioned against concavities of the other (3*b*), at a distance from each other, and further comprises spacer (37) between the flanges (35) of the bushes (3*a*, 3*b*), so as to form the cam groove having a constant section and controlled for ensuring a permanent contact between the rollers (2) and the corresponding cam section (95*a* or 95*b*).

2. Piston cam engine according to claim 1, characterized by the fact that the guides (10) are fixed to the housing (12), and the followers (1) move axially on the guides (10).

3. Piston cam engine according to claim 2, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

4. Piston cam engine according to claim 3, characterized by the fact that each ascending (101) or descending (102) sector of the curve (97) has by one maximal (109) and by one minimal (110) value of its second derivative which are displaced from the end points (113) of the given sector (101 or 102).

5. Piston cam engine according to claim 4, characterized by the fact that the values (111) of the second derivative of the curve (97) are equal to zero in the points of connection (113) of each two adjacent sectors (101, 102).

6. Piston cam engine according to claim 5, characterized by the fact that equal rectilinear sectors (112) are included in the zone of points of connection (105, 113) of the curve (97).

7. Piston cam engine according to claim 1, characterized by the fact, that the followers (1) are fixed to the guides (10) and the guides (10) can move axially (10) to the housing (12) and parallel to the axis of the cam (3).

8. Piston cam engine according to claim 7, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

9. Piston cam engine according to claim 8, characterized by the fact that each ascending (101) or descending (102) sector of the curve (97) has by one maximal (109) and by one minimal (110) value of its second derivative which are displaced from the end points (113) of the given sector (101 or 102).

10. Piston cam engine according to claim 9, characterized by the fact that the values (111) of the second derivative of the curve (97) are equal to zero in the points of connection (113) of each two adjacent sectors (101, 102).

11. Piston cam engine according to claim 10, characterized by the fact that equal rectilinear sectors (112) are included in the zone of points of connection (105, 113) of the curve (97).

12. Piston cam engine according to claim 1, characterized by the fact that the cross section of each cam section (95*a*, 95*b*) is a line arranged at angle of degrees different from 90.degree in towards the axes of the cam (3), which arrangement ensuring a reaction having radial component from the cam section (95) when contacting the roller (2), and the radial component direction is directed to the axes of the cam (3).

13. Piston cam engine according to claim 12, characterized by the fact that:

the axis of each arm (26') is a straight line coinciding with the direction of the contact reaction in top dead center of the piston (20);

the end of each arm (26') is formed as a fork, on fork arms a main bearing journal (4') is immovably mounted, carrying the main roller (2');

the main bearing journal (4') is tube-like shaped, in which hole an additional bearing journal (5') is positioned having axes parallel to the arm (26'), on which additional bearing journal (5') an additional roller (8') is mounted, so as the additional bearing journal (5') moving on the axes of the main bearing journal (4'), as the main roller (2') and the additional roller (8') each contacts with the one of said opposite cam sections (95*a*, 95*b*) of the cam (3).

14. Piston cam engine according to claim 13, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

15. Piston cam engine according to claim 14, characterized by the fact that each ascending (101) or descending (102) sector of the curve (97) has by one maximal (109) and by one minimal (110) value of its second derivative which are displaced from the end points (113) of the given sector (101 or 102).

16. Piston cam engine according to claim 15, characterized by the fact that the values (111) of the second derivative of the curve (97) are equal to zero in the points of connection (113) of each two adjacent sectors (101, 102).

17. Piston cam engine according to claim 16, characterized by the fact that equal rectilinear sectors (112) are included in the zone of points of connection (105, 113) of the curve (97).

18. Piston cam engine according to claim 12, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

19. Piston cam engine according to claim 18, characterized by the fact that each ascending (101) or descending (102) sector of the curve (97) has by one maximal (109) and by one minimal (110) value of its second derivative which are displaced from the end points (113) of the given sector (101 or 102).

20. Piston cam engine according to claim 19, characterized by the fact that the values (111) of the second derivative of the curve (97) are equal to zero in the points of connection (113) of each two adjacent sectors (101, 102).

21. Piston cam engine according to claim 20, characterized by the fact that equal rectilinear sectors (112) are included in the zone of points of connection (105, 113) of the curve (97).

22. Piston cam engine according to claim 1, characterized by the fact that:

the end of each arm (26) is formed as a main bearing journal (4), which free end forms additional bearing journal (5) eccentric disposed compared to the main bearing journal (4);

the roller (2) is mounted on the main bearing journal (4) and a additional roller (8) is mounted on the additional bearing journal (5), so as the main roller (2) and the additional roller (8) contact with the opposite cam sections (95*a*, 95*b*) of the cam (3);

further comprises elastic element (6) ensuring self-aligning toward the cam sections (95*a*, 95*b*).

23. Piston cam engine according to claim 22, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

24. Piston cam engine according to claim 23, characterized by the fact that each ascending (101) or descending (102) sector of the curve (97) has by one maximal (109) and by one minimal (110) value of its second derivative which are displaced from the end points (113) of the given sector (101 or 102).

25. Piston cam engine according to claim 24, characterized by the fact that the values (111) of the second derivative of the curve (97) are equal to zero in the points of connection (113) of each two adjacent sectors (101, 102).

26. Piston cam engine according to claim 25, characterized by the fact that equal rectilinear sectors (112) are included in the zone of points of connection (105, 113) of the curve (97).

27. Piston cam engine according to claim 1, characterized by the fact that further comprises at least one cylinder head (46) including variable means for delivery and means for discharge of working fluid (47, 48).

28. Piston cam engine according to claim 27, characterized by the fact that the corrugated cam section (95*a*, 95*b*) is made so that its curve of law of motion (97) of the followers (1) in function of the angle of cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing trough its point of junction (105, 113) and the line (106) is perpendicular to the tangent (107) to the curve (97) in this point (105, 113);

symmetrical toward the middle point (108) of a given ascending (101) or descending (102) sector.

29. Piston cam engine according to claim 28, characterized by the fact that each ascending (101) or descending (102) sector of the curve (97) has by one maximal (109) and by one minimal (110) value of its second derivative which are displaced from the end points (113) of the given sector (101 or 102).

30. Piston cam engine according to claim 29, characterized by the fact that the values (111) of the second derivative of the curve (97) are equal to zero in the points of connection (113) of each two adjacent sectors (101, 102).

31. Piston cam engine according to claim 30, characterized by the fact that equal rectilinear sectors (112) are included in the zone of points of connection (105, 113) of the curve (97).

32. Piston cam engine according to claim 1, characterized by the fact that the corrugated cam section (95*a*, 95*b*) is made so that its curve of law of motion (97) of the followers (1) in function of the angle of said cam (3) rotation is:

formed by consecutively alternating ascending (101) and descending (102) sectors in which connection equal number of convexities (104) and concavities (103) are obtained, which total number is equal to or multiple to the sum of the number of arms (26, 26') of the followers (1);

continuous at least up to its second derivative within one complete cam rotation (360°) which is valid including for the two end points (105);

symmetrical for every two adjacent ascending (101) and descending (102) sectors toward a line (106) passing through its point of junction (105, 113) and the line (106) is perpendicular to the tangent (107) to the curve (97) in this point (105, 113);

symmetrical toward the middle point (108) of a given ascending (101) or descending (102) sector.

33. Piston cam engine according to claim 32, characterized by the fact that each ascending (101) or descending (102) sector of the curve (97) has by one maximal (109) and by one minimal (110) value of its second derivative which are displaced from the end points (113) of the given sector (101 or 102).

34. Piston cam engine according to claim 33, characterized by the fact that the values (111) of the second derivative of the curve (97) are equal to zero in the points of connection (113) of each two adjacent sectors (101, 102).

35. Piston cam engine according to claim 34, characterized by the fact that equal rectilinear sectors (112) are included in the zone of points of connection (105, 113) of the curve (97).

36. Piston cam engine according to claim 1, characterized by the fact that it comprises more than one drive or driven shaft (39), each one rotary moved by the cam (3).

37. Piston cam engine according to claim 36, characterized by the fact that the drive or driven shaft (39) transmits or accepts motion from the cam (3) by means of chain drive.

38. An internal combustion engine, comprising:

(a) a housing;

(b) a drive or driven shaft (39);

(c) a cylindrical tubular 3D cam (3) having a cam groove on the inner cylindrical surface;

(d) at least one cylinder (13);

(e) a first piston (20) moving in the cylinder (13) and a second piston (20) moving in another cylinder (13) or a balancer (84) of the first piston (20) moving in the housing;

(f) at least two guides (10) for linear reciprocal motion of the first piston (20) and for the second piston (20) or for the balancer (84);

(g) two followers (1) having at least two arms (26), one follower of said two followers being connected to the first piston (20) and another follower of said two followers being connected to the second piston (20) or the balancer (84), and wherein the at least two arms of said two followers (1) are equally placed compared to the axes of power transmission (90), and (h) rollers (2) for moving in the cam groove and mounted on the ends of the arms (26), wherein the guides (10) are guide columns, parallel and equally placed compared to the axes of the cam (3), and wherein the cam (3) is composed and comprises two coaxial bushes (3*a*, 3*b*), each one having corrugated cam section (95*a* or 95*b*) from its one side and flange (35) from its other side, besides the bushes (3*a*, 3*b*) are positioned against each other with its corrugated ends in such a way that the convexities of one (3*a*) of the cam sections are positioned against concavities of the other (3*b*), at a distance from each other, and further comprises spacer (37) between the flanges (35) of the bushes (3*a*, 3*b*), so as to form the cam groove having a constant section and controlled for ensuring a permanent contact between the rollers (2) and the corresponding cam section (95*a* or 95*b*); and (i) a valve-timing mechanism, which valve-timing mechanism includes at least one kinematic chain having one discharge or one inlet cam (50 or 51), a valve (49), a rocker (52) with roller (53) on a first end contacting with the discharge or inlet cam (50 or 51) of said kinematic chain, and its opposing end connected to said valve (49) and said rocker (52) is connected by a hinge (54) to said housing, and said discharge or inlet cam (50 or 51) is a flat 2D cam fixed coaxially to the cam (3).

39. Motor according to claim 38, characterized by the fact that it is a four-stroke two-piston engine, which valve-timing mechanism consists of four kinematic chains, two of which are discharge and the other two are inlet chains, which kinematic chains are located by two different discharge and inlet chains of each side of the cam (3).

40. Motor according to claim 38, characterized by the fact that it is four-stroke one-piston engine, which valve-timing mechanism consists of two kinematic chains, one of which is discharge chain and the other is inlet chain, which kinematic chains are located on the side of the cylinder (13).

41. Motor according to claim 38, characterized by the fact that it is two-stroke two-piston engine, which valve-timing mechanism consists of two kinematic discharge chains located by one of each side of the cam (3), and each cylinder (13) has windows (79) for supplying with fresh working substance.

42. Motor according to claim 38, characterized by the fact that it is two-stroke one-piston engine, which valve-timing mechanism consists of one kinematic discharge chain.

43. Motor according to claim 38, characterized by the fact that it comprises one operating cylinder working at four- or two-stroke process, and one opposite cylinder (87) which is cylinder of compressor or pump.

44. Motor according to claim 43, characterized by the fact that the opposite cylinder (87) is a cylinder of compressor, and at least part of the compressed air from the compressor cylinder (87) feeds the operating cylinder (86) through a pneumatic accumulator (85) where the air is stored and/or fuel-air mixture is prepared for the next working cycle of the operating cylinder (86).

* * * * *